US005315939A

United States Patent [19]

Rini et al.

[11] Patent Number: 5,315,939

[45] Date of Patent: May 31, 1994

[54] INTEGRATED LOW $NO_x$ TANGENTIAL FIRING SYSTEM

[75] Inventors: Michael J. Rini, Hebron; Todd D. Hellewell, Windsor; David P. Towle, Simsbury, all of Conn.; Patrick L. Jennings, Granville, Mass.; Richard C. LaFlesh, Suffield, Conn.; David K. Anderson, East Longmeadow, Mass.

[73] Assignee: Combustion Engineering, Inc., Windsor, Conn.

[21] Appl. No.: 62,634

[22] Filed: May 13, 1993

[51] Int. Cl.[5] ..... F23D 1/02

[52] U.S. Cl. ..... 110/264; 110/232; 110/347; 431/173

[58] Field of Search ..... 110/264, 347, 263, 232; 431/173

[56] References Cited

U.S. PATENT DOCUMENTS 4,419,941 12/1983 Samtalla ..... 110/232
4,715,301 12/1987 Bianca et al. ..... 110/347
5,205,226 4/1993 Kitto, Jr. et al. ..... 110/264

*Primary Examiner*—Edward G. Favors
*Attorney, Agent, or Firm*—Arthur E. Fournier, Jr.

[57] ABSTRACT

An integrated low $NO_x$ tangential firing system (12) that is particularly suited for use with pulverized solid fuel-fired furnaces (10), and a method of operating a pulverized solid fuel-fired furnace (10) equipped with an integrated low $NO_x$ tangential firing system (12). The integrated low $NO_x$ tangential firing system (12) when so employed with a pulverized solid fuel-fired furnace (10) is capable of limiting $NO_x$ emissions therefrom to less than 0.15 lb./$10^6$ BTU, while yet maintaining carbon-in-flyash to less than 5% and CO emissions to less than 50 ppm. The integrated low $NO_x$ tangential firing system (12) includes pulverized solid fuel supply means (62), flame attachment pulverized solid fuel nozzle tips (60), concentric firing nozzles, close-coupled overfire air (98,100), and multi-staged separate overfire air (104,106).

25 Claims, 11 Drawing Sheets

INTEGRATED LOW $NO_x$ TANGENTIAL FIRING SYSTEM

BACKGROUND OF THE INVENTION

This invention relates to tangential firing systems for use with pulverized solid fuel-fired furnaces, and more specifically, to an integrated low $NO_x$ tangential firing system, which is applicable to a wide range of solid fuels and which when employed with a pulverized solid fuel-fired furnace is capable of limiting $NO_x$ emissions therefrom to levels consistent with alternate solid fuel-based power generation technologies.

Pulverized solid fuel has been successfully burned in suspension in furnaces by tangential firing methods for a long time. The tangential firing technique involves introducing the pulverized solid fuel and air into a furnace from the four corners thereof so that the pulverized solid fuel and air are directed tangent to an imaginary circle in the center of the furnace. This type of firing has many advantages, among them being good mixing of the pulverized solid fuel and the air, stable flame conditions, and long residence time of the combustion gases in the furnaces.

Recently though, more and more emphasis has been placed on the minimization as much as possible of air pollution. In this connection, with reference in particular to the matter of $NO_x$ control it is known that oxides of nitrogen are created during fossil fuel combustion primarily by two separate mechanisms which have been identified to be thermal $NO_x$ and fuel $NO_x$ Thermal $NO_x$ results from the thermal fixation of molecular nitrogen and oxygen in the combustion air. The rate of formation of thermal $NO_x$ is extremely sensitive to local flame temperature and somewhat less so to local concentration of oxygen. Virtually all thermal $NO_x$ is formed at the region of the flame which is at the highest temperature. The thermal $NO_x$ concentration is subsequently "frozen" at the level prevailing in the high temperature region by the thermal quenching of the combustion gases. The flue gas thermal $NO_x$ concentrations are, therefore, between the equilibrium level characteristic of the peak flame temperature and the equilibrium level at the flue gas temperature.

On the other hand, fuel $NO_x$ derives from the oxidation of organically bound nitrogen in certain fossil fuels such as coal and heavy oil. The formation rate of fuel $NO_x$ is strongly affected by the rate of mixing of the fossil fuel and air stream in general, and by the local oxygen concentration in particular. However, the flue gas $NO_x$ concentration due to fuel nitrogen is typically only a fraction, e.g., 20 to 60 percent, of the level which would result from complete oxidation of all nitrogen in the fossil fuel. From the preceding it should thus now be readily apparent that overall $NO_x$ formation is a function both of local oxygen levels and of peak flame temperatures.

Over the years, there have been numerous modifications made to the standard tangential firing technique. Many of these modifications, and in particular those that have been suggested most recently, have been proposed primarily in the interest of achieving an even better reduction of emissions through the use thereof. The resultant of one such modification is the firing system that forms the subject matter of U.S. Pat. No. 5,020,454 entitled "Clustered Concentric Tangential Firing System", which issued on Jun. 4, 1991 and which is assigned to the same assignee as the present patent application. In accordance with the teachings of U.S. Pat. No. 5,020,454, there is provided a clustered concentric tangential firing system that is particularly suited for use in fossil fuel-fired furnaces. The clustered concentric tangential firing system includes a windbox. A first cluster of fuel nozzles are mounted in the windbox and are operative for injecting clustered fuel into the furnace so as to thereby create a first fuel-rich zone therewithin. A second cluster of fuel nozzles are mounted in the windbox and are operative for injecting clustered fuel into the furnace so as to thereby create a second fuel-rich zone therewithin. An offset air nozzle is mounted in the windbox and is operative for injecting offset air into the furnace such that the offset air is directed away from the clustered fuel injected into the furnace and towards the walls of the furnace. A close coupled overfire air nozzle is mounted in the windbox and is operative for injecting close coupled overfire air into the furnace. A separated overfire air nozzle is mounted within the burner region of the furnace so as to be spaced from the close coupled overfire air nozzle and so as to be substantially aligned with the longitudinal axis of the windbox. The separated overfire air nozzle is operative for injecting separated overfire air into the furnace.

The resultant of another such modification is the firing system that forms the subject matter of U.S. Pat. No. 5,146,858, which is entitled "Boiler Furnace Combustion System" and which issued on Sep. 15, 1992. In accordance with the teachings of U.S. Pat. No. 5,146,858, a boiler furnace combustion system is provided of the type that typically includes main burners disposed on side walls of or at corners of a square-barrel-shaped boiler furnace having a vertical axis with the burner axes being directed tangentially to an imaginary cylindrical surface coaxial to the furnace. Moreover, in this type of boiler furnace combustion system air nozzles are disposed in the boiler furnace at a level above the main burners so that unburnt fuel left in a reducing atmosphere or a lower oxygen concentration atmosphere of a main burner combustion region can be perfectly burnt by additional air blown through the air nozzles. The boiler furnace combustion system, as taught in U.S. Pat. No. 5,146,858, is particularly characterized in that two groups of air nozzles are disposed at higher and lower levels, respectively. More specifically, the air nozzles at the lower level are provided at the corners of the boiler furnace with their axes directed tangentially to a second imaginary coaxial cylindrical surface having a larger diameter than the first imaginary coaxial cylindrical surface. The air nozzles at the higher level, on the other hand, are provided at the centers of the side wall surfaces of the boiler furnace with their axes directed tangentially to a third imaginary coaxial cylindrical surface having a smaller diameter than the second imaginary coaxial cylindrical surface.

The resultant of yet another such modification is the firing system that forms the subject matter of U.S. Pat. No. 5,195,450 entitled "Advanced Overfire Air System for $NO_x$ Control", which issued on Mar. 23, 1993 and which is assigned to the same assignee as the present patent application. In accordance with the teachings of U.S. Pat. No. 5,195,450, there is provided an advanced overfire air system for $NO_x$ control, which is designed for use in a firing system of the type that is particularly suited for use in fossil fuel-fired furnaces. The advanced overfire air system for $NO_x$ control includes multi-elevations of overfire air compartments consisting of a plurality of close coupled overfire air compartments and a plurality of separated overfire air compartments. The close coupled overfire air compartments are supported at a first elevation in the furnace and the separated overfire air compartments are supported at a second elevation in the furnace so as to be spaced from but aligned with the close coupled overfire air compartments. Overfire air is supplied to both the close coupled overfire air compartments and the separated overfire air compartments such that there is a predetermined most favorable distribution of overfire air therebetween, such that the overfire air exiting from the separated overfire air compartments establishes a horizontal "spray" or "fan" distribution of overfire air over the plan area of the furnace, and such that the overfire air exits from the separated overfire air compartments at velocities significantly higher than the velocities employed heretofore.

Throughout the 1990s and into the twenty-first century large, central pulverized solid fuel-fired power stations are expected to play an important role in worldwide power generation. These stations will be designed for maximum cycle efficiency, multiple-fuel flexibility, cycling, maximum availability, least capital cost, minimum maintenance cost, and lowest possible emissions that meet or exceed federal, state and local rules. Historically, tangential firing has demonstrated inherently low $NO_x$ production for large, pulverized solid fuel-fired furnaces. Lower $NO_x$ emissions result from the staging that occurs with the physical separation of the pulverized solid fuel and air streams emanating from the corner windboxes. The flames produced at each pulverized solid fuel nozzle are stabilized through global heat- and mass-transfer processes. A single rotating flame envelope ("fireball"), centrally located in the furnace, provides gradual but thorough and uniform pulverized solid fuel-air mixing throughout the entire furnace. This tangential firing process has been an advantage in developing advanced air staging systems for combustion $NO_x$ control. In contrast, wall-fired furnaces utilize groups of individually self-stabilizing burners that do not use global furnace flow patterns to achieve uniform pulverized solid fuel and air mixing. As a result, wall-fired arrangements, even though employing separated overfire air, typically create local zones of high temperature and $O_2$ concentrations that cause $NO_x$ formation.

Thus, although firing systems constructed in accordance with the teachings of the three issued U.S. patents to which reference has been made hereinbefore have been demonstrated to be operative for the purpose for which they have been designed, there has nevertheless been evidenced in the prior art a need for such firing systems to be improved. More specifically, a need has been evidenced in the prior art for a new and improved tangential firing system that would enable $NO_x$ emissions from pulverized solid fuel-fired furnaces to be controlled at levels, which are consistent with alternate pulverized solid fuel-based power generation technologies, such as circulating fluidized bed (CFB) and integrated gasification combined cycle (IGCC), without utilizing either selective catalytic reduction (SCR) or selective non-catalytic reduction (SNCR). To this end, a need has been evidenced in the prior art for a new and improved tangential firing system that would enable the $NO_x$ emissions from pulverized solid fuel-fired furnaces to be limited to less than 0.15 lb./$10^6$ BTU, while yet at the same time limiting carbon-in-flyash to less than 5% and CO emissions to less than 50 ppm. Moreover, such emissions levels should be attainable while a wide range of solid fuels, from medium-volatile bituminous coal through lignite, are being fired in a pulverized solid fuel-fired furnace that has been equipped with such a new and improved tangential firing system. Finally, there is a need in order that such a new and improved tangential firing system may be provided that attention be focused on the entire pulverized solid fuel combustion system, including pulverization, primary air flow, fuel admission assemblies, and multiple levels of air injection (auxiliary air, close-coupled overfire air, and separated overfire air). To this end, such a new and improved tangential firing system may be viewed as consisting of the following four major elements: solid fuel pulverization and classification, pulverized solid fuel admission and combustion near the pulverized solid fuel nozzle tip, lower furnace combustion, and upper furnace combustion (between the main windbox and the furnace arch). Moreover, such a new and improved tangential firing system should be predicated on the optimization therewithin of these four above-enumerated individual elements.

To thus summarize, a need has been evidenced in the prior art for a new and improved tangential firing system that when employed with a pulverized solid fuel-fired furnace is capable of meeting 0.10 to 0.15 lb./$10^6$ BTU $NO_x$ emissions levels on Eastern U.S. bituminous coals, and of making pulverized solid fuel firing in a pulverized solid fuel-fired furnace competitive on an emissions basis with other new solid fuel-fired technology options, such as fluidized bed combustors and IGCC. Moreover, with such a new and improved tangential firing system the $NO_x$ emission target is to be achieved through combustion techniques only, while maintaining carbon-in-flyash at less than 5% and CO emissions at less than 50 ppm. That is, such a new and improved tangential firing system should be capable of enabling minimum total emissions to be achieved therewith. In this regard, techniques employed to reduce $NO_x$ formation, such as sub-stoichiometric primary zone combustion, staging of pulverized solid fuel and air mixing, reduced excess air, and lower heat release rates, are all aimed at controlling oxygen availability, the combustion rate and reducing peak flame temperatures. However, since these conditions may increase the potential for CO, hydrocarbons, and increased unburned carbon emissions, it is necessary that in such a new and improved tangential firing system that a balance be achieved among these opposing factors. Namely, it is necessary that such a new and improved tangential firing system comprise an integrated tangential firing system wherein finer solid fuel pulverization is combined with advanced pulverized solid fuel admission assemblies and in-furnace air staging utilizing multiple air injection levels. It is the integration of these features, which distinguishes such a new and improved integrated tangential firing system from prior art forms of firing systems.

The need for finer solid fuel pulverization is predicated on the need to minimize combustible losses (unburned carbon) caused by the staged combustion process for $NO_x$ control. Finer pulverized solid fuel can result in close ignition at the pulverized solid fuel nozzle tip discharge, enhancing fuel-bound nitrogen release and its subsequent reduction to $N_2$ under staged conditions. Secondary benefits include fewer large (>100 mesh) particles impinging on the waterwalls of the pulverized solid fuel-fired furnace and improved low-load ignition stability.

The need for advanced pulverized solid fuel admission assemblies is to ensure that the ignition point of the pulverized solid fuel occurs closer to the nozzle tip than it does with conventional pulverized solid fuel nozzle tips. The rapid ignition of the pulverized solid fuel produces a stable volatile matter flame and minimizes $NO_x$ production in the pulverized solid fuel-rich stream. In addition, there should also exist the capability with the advanced pulverized solid fuel admission assemblies to horizontally offset some of the windbox secondary airflow in order to thereby make less air available to the pulverized solid fuel stream during the early stages of combustion. Such horizontally offsetting of some of the windbox secondary airflow also creates an oxidizing environment near the waterwalls of the pulverized solid fuel-fired furnace in and above the firing zone. This reduces ash deposition quantity and tenacity and results in both less wall soot blower usage and increased lower furnace heat absorption. Increased $O_2$ levels along the waterwalls of the pulverized solid fuel-fired furnace also reduce corrosion potential, especially when coals with high concentrations of sulfur, iron, or alkali metals (K, Na) are fired. Corrosion by sulfidation or other mechanism(s) can be largely controlled in practice by minimizing the potential for direct fuel impingement on the waterwalls of the pulverized solid fuel-fired furnace. This potential is addressed via conservative heat release parameters and pulverized solid fuel-fired furnace geometries, as well as improved pulverized solid fuel fineness control.

The need for in-furnace air staging utilizing multiple air injection levels is predicated on the need to discharge a portion of the secondary air through air compartments at the top of the main windbox to improve carbon burnout without increasing $NO_x$ production. In addition, there should also exist the capability with the in-furnace air staging utilizing multiple air injection levels to control firing zone stoichiometry through multi-staged separated overfire air (SOFA). Two or more discrete levels of overfire air are incorporated in the corners of the pulverized solid fuel-fired furnace between the top of the main windbox and the pulverized solid fuel-fired furnace outlet plane to create the optimum stoichiometry history for $NO_x$ control for a given pulverized solid fuel. The SOFA compartments have adjustable yaw and tilt positioning, which allows tuning of the combustion air and pulverized solid fuel-fired furnace gas mixing process for maximum control of combustible emissions such as carbon, CO, total hydrocarbons (THC) and polycyclic aromatic compounds (PAC).

It is, therefore, an object of the present invention to provide a new and improved tangential firing system that is particularly suited for use with pulverized solid fuel-fired furnaces.

It is a further object of the present invention to provide such a new and improved tangential firing system for pulverized solid fuel-fired furnaces which is characterized in that through the use thereof $NO_x$ emissions from pulverized solid fuel-fired furnaces can be controlled at levels, which are consistent with alternate pulverized solid fuel-based power generation technologies, such as circulating fluidized bed (CFB) and integrated gasification combined cycle (IGCC), without utilizing either selective catalytic reduction (SCR) or selective non-catalytic reduction (SNCR).

It is another object of the present invention to provide such a new and improved tangential firing system for pulverized solid fuel-fired furnaces which is characterized in that through the use thereof $NO_x$ emissions from pulverized solid fuel-fired furnaces can be less than 0.15 lb./$10^6$ BTU.

It is still another object of the present invention to provide such a new and improved tangential firing system for pulverized solid fuel-fired furnaces which is characterized in that through the use thereof $NO_x$ emissions from pulverized solid fuel-fired furnaces can be limited to less than 0.15 lb./$10^6$ BTU while yet at the same time limiting carbon-in-flyash to less than 5% and CO emissions to less than 50 ppm.

Another object of the present invention is to provide such a new and improved tangential firing system for pulverized solid fuel-fired furnaces which is characterized in that through the use thereof $NO_x$ emissions from pulverized solid fuel-fired furnaces can be limited to less than 0.15 lb./$10^6$ BTU while a wide range of solid fuels, from medium-volatile bituminous coal through lignite, are being fired in the pulverized solid fuel-fired furnace.

A still another object of the present invention is to provide such a new and improved tangential firing system for pulverized solid fuel-fired furnaces which is characterized in that included therewithin as an element thereof is solid fuel pulverization and classification.

A further object of the present invention is to provide such a new and improved tangential firing system for pulverized solid fuel-fired furnaces which is characterized in that included therewithin as an element thereof is pulverized solid fuel admission and combustion near the pulverized solid fuel nozzle tip.

A still further object of the present invention is to provide such a new and improved tangential firing system for pulverized solid fuel-fired furnaces which is characterized in that included therewithin as an element thereof is lower furnace combustion.

Yet an object of the present invention is to provide such a new and improved tangential firing system for pulverized, solid fuel-fired furnaces which is characterized in that included therewithin as an element thereof is upper furnace combustion.

Yet a further object of the present invention is to provide such a new and improved tangential firing system for pulverized solid fuel-fired furnaces which is characterized in that finer solid fuel pulverization is combined therewithin with advanced pulverized solid fuel admission assemblies and in-furnace air staging utilizing multiple air injection levels such that the new and improved tangential firing system thereby constitutes a new and improved integrated tangential firing system for pulverized solid fuel-fired furnaces.

Yet another object of the present invention is to provide such a new and improved integrated tangential firing system for pulverized solid fuel-fired furnaces which is characterized in that it is equally well suited for use in either new applications or in retrofit applications.

Yet still another object of the present invention is to provide such a new and improved integrated tangential firing system for pulverized solid fuel-fired furnaces which is characterized in that it is relatively easy to install, relatively simple to operate, yet is relatively inexpensive to provide.

SUMMARY OF THE PRESENT INVENTION

In accordance with one aspect of the present invention there is provided an integrated low $NO_x$ tangential firing system that is particularly suited for use with pulverized solid fuel-fired furnaces. The subject integrated low $NO_x$ tangential firing system includes pulverized solid fuel supply means, flame attachment pulverized solid fuel nozzle tips, concentric firing nozzles, close-coupled overfire air, and multi-staged separate overfire air. The pulverized solid fuel supply means is designed so as to be operable to provide pulverized solid fuel having minimum fineness levels of approximately 0% on a 50-mesh sieve, 1.5% on a 100-mesh sieve and more than 85% passing through a 200-mesh sieve. A 50-mesh sieve, a 100-mesh sieve and a 200-mesh sieve are deemed to be so sized as to permit the passage therethrough of particles having a size of approximately 300 microns, 150 microns and 74 microns, respectively. The primary benefit of utilizing pulverized solid fuel having such fineness levels is the ability to thereby minimize combustible losses (unburned carbon) caused by the staged combustion process for $NO_x$ control which the subject integrated low $NO_x$ tangential firing system employs. The flame attachment pulverized solid fuel nozzle tips are designed so as to be operable to effect the injection therethrough of the pulverized solid fuel supplied thereto by the pulverized solid fuel supply means in such a manner that the ignition point of the pulverized solid fuel occurs closer to the nozzle tip than it does with prior art forms of pulverized solid fuel nozzle tips. The concentric firing nozzles are designed so as to be operable for horizontally offsetting some of the secondary airflow whereby less air is available to the pulverized solid fuel stream during the early stages of combustion, and such that combustion of the pulverized solid fuel occurs at stoichiometries less than 0.85 and down as low as 0.4, but preferably in a range of between 0.5 and 0.7. The close coupled overfire air, which is injected into the pulverized solid fuel-fired furnace through air compartments located at the top of the main windbox, is designed to be effective to improve carbon burnout without increasing $NO_x$ production. The multi-staged separated overfire air is designed to be injected into the pulverized solid fuel-fired furnace through air compartments at two or more discrete levels, which are located between the top of the main windbox and the outlet plane of the pulverized solid fuel-fired furnace, such that the time that is takes for the gas generated from the combustion of the pulverized solid fuel to travel from the top of the main windbox to the top of the last level of separated overfire air, i.e., the residence time, exceeds 0.3 seconds.

In accordance with another aspect of the present invention there is provided a method of operating, a pulverized solid fuel-fired furnace that is equipped with an integrated low $NO_x$ tangential firing system. The subject method of operating a pulverized solid fuel-fired furnace that is equipped with an integrated low $NO_x$ tangential firing system includes the steps of providing a supply of pulverized solid fuel having minimum fineness levels of approximately 0% on a 50-mesh sieve, 1.5% on a 100-mesh sieve and more than 85% passing through a 200-mesh sieve; injecting the pulverized solid fuel having the fineness levels enumerated above, which has been supplied to flame attachment nozzle tips, into the pulverized solid fuel-fired furnace through the flame attachment nozzle tips in such a manner that the ignition point of the pulverized solid fuel occurs in close proximity to the flame attachment nozzle tips so as to thereby produce a stable volatile matter flame and to minimize $NO_x$ production in the pulverized solid fuel-rich stream; injecting a portion of the secondary airflow into the pulverized solid fuel-fired furnace through air compartments located in the main windbox such that this portion of the secondary airflow is horizontally offset relative to the longitudinal axis of the pulverized solid fuel-fired furnace; injecting another portion of the secondary air in the form of close coupled overfire air into the pulverized solid fuel-fired furnace through air compartments located at the top of the main windbox in order to thereby improve carbon burnout without increasing $NO_x$ production; injecting yet another portion of the secondary air in the form of separated overfire air into the pulverized solid fuel-fired furnace through two or more discrete levels of air compartments located between the top of the main windbox and the outlet plane of the pulverized solid fuel-fired furnace such that the time that it takes for the gases generated from the combustion of the pulverized solid fuel to travel from the top of the main windbox to the top of the last level of separated overfire air exceeds 0.3 seconds.

DESCRIPTION OF THE PREFERRED EMBODIMENT

Figure 1:
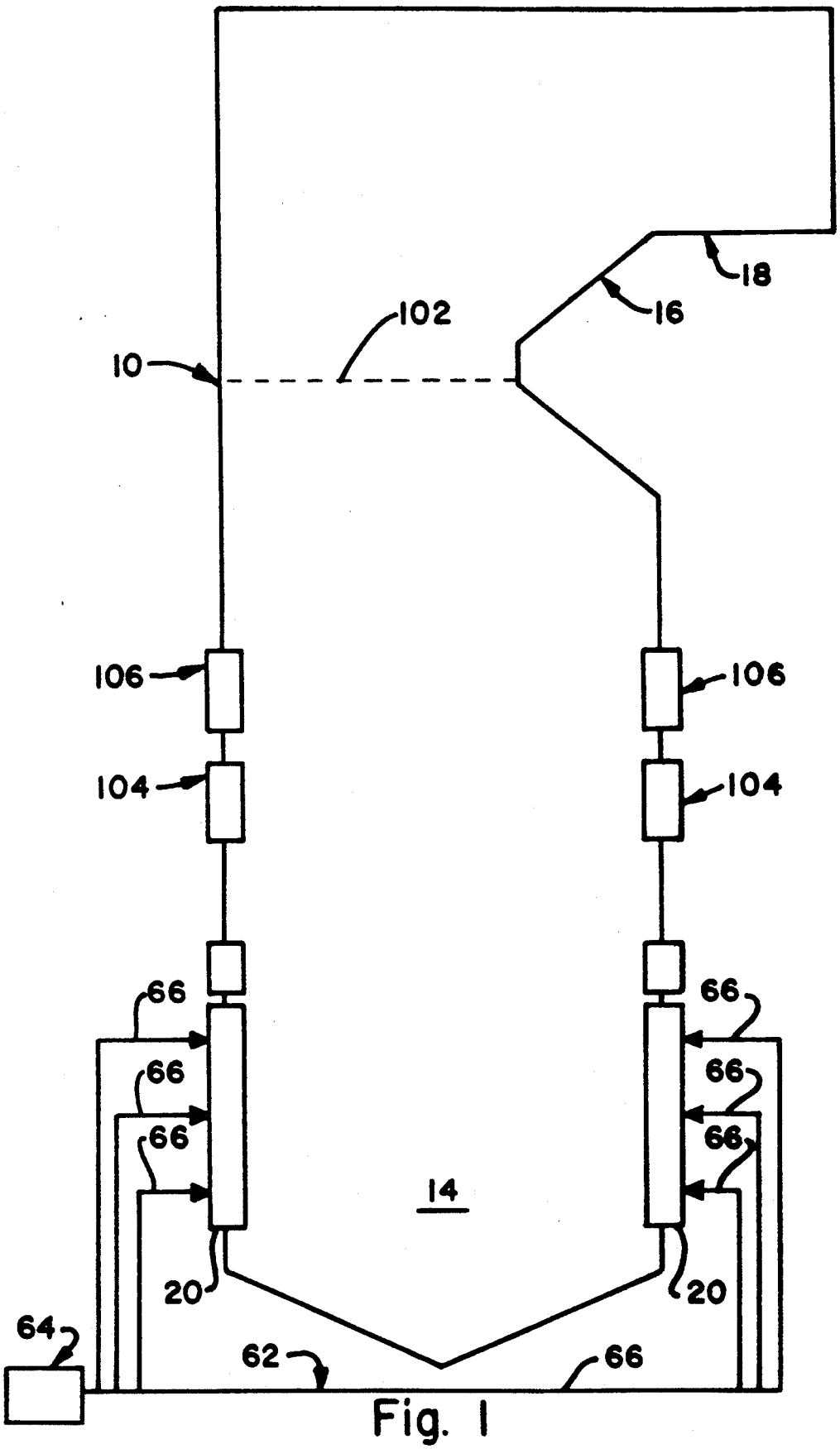
FIG. 1 is a diagrammatic representation in the nature of a vertical sectional view of a pulverized solid fuel-fired furnace embodying an integrated low $NO_x$ tangential firing system constructed in accordance with the present invention.

Referring now to the drawing, and more particularly to FIG. 1 thereof, there is depicted therein a pulverized solid fuel-fired furnace, generally designated by reference numeral 10. Inasmuch as the nature of the construction and the mode of operation of pulverized solid fuel-fired furnaces per se are well known to those skilled in the art, it is not deemed necessary, therefore, to set forth herein a detailed description of the pulverized solid fuel-fired furnace 10 illustrated in FIG. 1. Rather, for purposes of obtaining an understanding of a pulverized solid fuel-fired furnace 10, which is capable of having cooperatively associated therewith an integrated low $NO_x$ tangential firing system, generally designated by the reference numeral 12 in FIG. 2 of the drawing, that in accordance with the present invention is capable of being installed therein and when so installed therein the integrated low $NO_x$ tangential firing system 12 is operative for limiting the $NO_x$ emission from the pulverized solid fuel-fired furnace 10 to less than 0.15 lb./$10^6$ BTU, while yet at the same time the carbon-in-flyash from the pulverized solid fuel-fired furnace 10 is limited to less than 5% and the CO emissions from the pulverized solid fuel-fired furnace are limited to less than 50 ppm, it is deemed to be sufficient that there be presented herein merely a description of the nature of the components of the pulverized solid fuel-fired furnace 10 with which the aforesaid integrated low $NO_x$ tangential firing system 12 cooperates. For a more detailed description of the nature of the construction and the mode of operation of the components of the pulverized solid fuel-fired furnace 10, which are not described herein, one may have reference to the prior art, e.g., U.S. Pat. No. 4,719,587, which issued Jan. 12, 1988 to F. J. Berte and which is assigned to the same assignee as the present patent application.

Referring further to FIG. 1 of the drawing, the pulverized solid fuel-fired furnace 10 as illustrated therein includes a burner region, generally designated by the reference numeral 14. As will be described more fully hereinafter in connection with the description of the nature of the construction and the mode of operation of the integrated low $NO_x$ tangential firing system 12, it is within the burner region 14 of the pulverized solid fuel-fired furnace 10 that in a manner well-known to those skilled in this art combustion of the pulverized solid fuel and air is initiated. The hot gases that are produced from combustion of the pulverized solid fuel and air rise upwardly in the pulverized solid fuel-fired furnace. During the upwardly movement thereof in the pulverized solid fuel-fired furnace 10, the hot gases in a manner well-known to those skilled in this art give up heat to the fluid passing through the tubes (not shown in the interest of maintaining clarity of illustration in the drawing) that in conventional fashion line all four of the walls of the pulverized solid fuel-fired furnace 10. Then, the hot gases exit the pulverized solid fuel-fired furnace 10 through the horizontal pass, generally designated by the reference numeral 16, of the pulverized solid fuel-fired furnace 10, which in turn leads to the rear gas pass, generally designated by the reference numeral 18, of the pulverized solid fuel-fired furnace 10. Both the horizontal pass 16 and the rear gas pass 18 commonly contain other heat exchanger surface (not shown) for generating and super heating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

Figure 2:
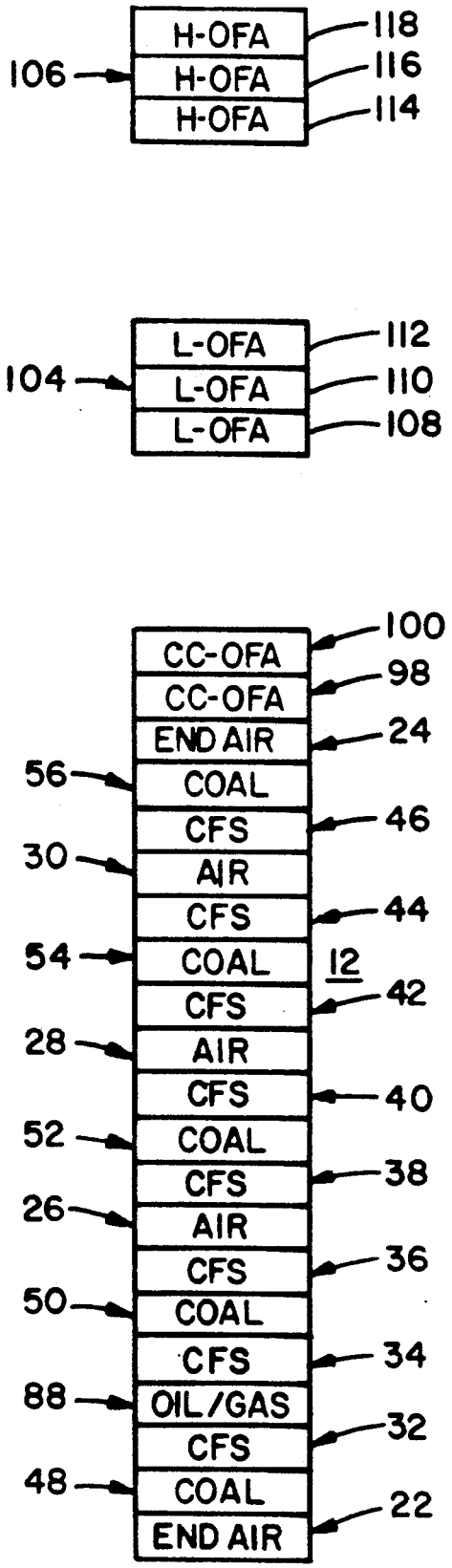
FIG. 2 is a diagrammatic representation in the nature of a vertical sectional view of an integrated low $NO_x$ tangential firing system, which is particularly suited for use in pulverized solid fuel-fired furnace applications, constructed in accordance with the present invention.

With the preceding by way of background, reference will now be had particularly to FIGS. 1 and 2 of the drawing for purposes of describing the integrated low $NO_x$ tangential firing system 12, which in accordance with the present invention is designed to be cooperatively associated with a furnace constructed in the manner of the pulverized solid fuel-fired furnace 10 that is depicted in FIG. 1 of the drawing. More specifically, the integrated low $NO_x$ tangential firing system 12 is designed to be utilized in a furnace such as the pulverized solid fuel-fired furnace 10 of FIG. 1 of the drawing so that when so utilized therewith the integrated low $NO_x$ tangential firing system 12 is operative to limit the $NO_x$ emissions from the pulverized solid fuel-fired furnace 10 to less than 0.15 lb./$10^6$ BTU, while yet at the same time the carbon-in-flyash from the pulverized solid fuel-fired furnace 10 is limited to less than 5% and the CO emissions from the pulverized solid fuel-fired furnace 10 are limited to less than 50 ppm.

As best understood with reference to FIGS. 1 and 2 of the drawing, the integrated low $NO_x$ tangential firing system 12 includes a housing preferably in the form of a main windbox, denoted by the reference numeral 20 in FIGS. 1 and 2 of the drawing. The main windbox 20 in a manner well-known to those skilled in this art is supported by conventional support means (not shown) in the burner region 14 of the pulverized solid fuel-fired furnace 10 such that the longitudinal axis of the main windbox 20 extends substantially in parallel relation to the longitudinal axis of the pulverized solid fuel-fired furnace 10.

Continuing with the description of the integrated low $NO_x$ tangential firing system 12, in accord with the embodiment thereof illustrated in FIG. 2 of the drawing, the main windbox 20 includes a pair of end air compartments, denoted generally by the reference numerals 22 and 24, respectively. As best understood with reference to FIG. 2 of the drawing, one of the end air compartments, i.e., that denoted by the reference numeral 22, is provided at the lower end of the main windbox 20. The other end air compartment, i.e., that denoted by the reference numeral 24, is provided in the upper portion of the main windbox 20. In addition, in accord with the illustration thereof in FIG. 2 of the drawing, there are also provided in the main windbox 20 a plurality of straight air compartments, denoted generally by the reference numerals 26, 28 and 30, respectively, in FIG. 2, and a plurality of offset air compartments, denoted generally by the reference numerals 32, 34, 36, 38, 40, 42, 44 and 46, respectively, in FIG. 2. A straight air nozzle is supported in mounted relation, through the use of any conventional form of mounting means suitable for use for such a purpose, within each of the end air compartments 22 and 24, and within each of the straight air compartments 26, 28 and 30. However, an offset air nozzle for a purpose to be described more fully herein subsequently is supported in mounted relation, through the use of any conventional form of mounting means suitable for use for such a purpose, within each of the offset air compartments 32, 34, 36, 38, 40, 42, 44 and 46. An air supply means (not shown in the interest of maintaining clarity of illustration in the drawing) is operatively connected to each of the end air compartments 22 and 24, to each of the straight air compartments 26, 28 and 30, and to each of the offset air compartments 32, 34, 36, 38, 40, 42, 44 and 46 whereby the air supply means supplies air thereto and therethrough into the burner region 14 of the pulverized solid fuel-fired furnace 10. To this end, the air supply means in known fashion includes a fan (not shown) and air ducts (not shown) which are connected in fluid flow relation to the fan on the one hand and to the end compartments 22 and 24, the straight air compartments 26, 28 and 30, and the offset air compartments 32, 34, 36, 38, 40, 42, 44 and 46, respectively, on the other hand, through separate valves and controls (not shown).

With further reference to the main windbox 20, in accord with the embodiment thereof illustrated in FIG. 2 of the drawing the main windbox 20 is also provided with a plurality of fuel compartments, denoted generally by the reference numerals 48, 50, 52, 54 and 56, respectively. Supported in mounted relation within each of the fuel compartments 48, 50, 52, 54 and 56 is a fuel nozzle, the latter being illustrated in FIG. 3 of the drawing wherein the fuel nozzle is denoted generally by the reference numeral 58. Any conventional form of mounting means suitable for use for such a purpose may be employed to mount a fuel nozzle 58 in each of the fuel compartments 48, 50, 52, 54 and 56. For a purpose to be described more fully herein subsequently, the fuel nozzle 58 embodies a flame attachment pulverized solid fuel nozzle tip, the latter being illustrated in FIG. 4 of the drawing wherein the flame attachment pulverized solid fuel nozzle tip is denoted generally by the reference numeral 60. Each of the fuel compartments 48, 50, 52, 54 and 56, by way of exemplification and not limitation, is denoted in FIG. 2 of the drawing as being a coal compartment. It is to be understood, however, that the fuel compartments 48, 50, 52, 54 and 56 are also suitable for use with other forms of pulverized solid fuel, i.e., with any form of pulverized solid fuel which is capable of being combusted within the burner region 14 of the pulverized solid fuel-fired furnace 10.

A pulverized solid fuel supply means, which is illustrated schematically in FIG. 1 of the drawing wherein the pulverized solid fuel supply means is denoted generally by the reference numeral 62, is operatively connected to the fuel nozzles 58, which are supported in mounted relation within the fuel compartments 48, 50, 52, 54 and 56, whereby the pulverized solid fuel supply means 62 supplies pulverized solid fuel to the fuel compartments 48, 50, 52, 54 and 56, and more specifically to the fuel nozzles 58 supported in mounted relation therewithin for injection therefrom into the burner region 14 of the pulverized solid fuel-fired furnace 10. To this end, the pulverized solid fuel supply means 62 includes a pulverizer, seen at 64 in FIG. 1 of the drawing and the pulverized solid fuel ducts, denoted by the reference numeral 66. The pulverizer 64 is designed to produce pulverized solid fuel of minimum finenesses of approximately 0% on a 50-mesh sieve, 1.5% on a 100-mesh sieve and more than 85% on a 200-mesh sieve, wherein 50-mesh, 100-mesh and 200-mesh are equivalent to particles having a size of approximately 300 microns, 150 microns and 74 microns, respectively. Further to this point, the pulverizer 64 embodies a dynamic classifier (not shown). Moreover, in accord with the mode of operation of the dynamic classifier (not shown), rotating classifier vanes impart centrifugal forces onto the pulverized solid fuel particles as they are transported through the dynamic classifier (not shown) by the air stream. The balance of the forces created by the air stream and the rotating classifier vanes separates the large particles from the small particles. The small particles exit from the dynamic classifier (not shown), while the larger particles are retained within the pulverizer 64 for further pulverization. The primary need for finer solid fuel is to minimize combustible losses (unburned carbon) caused by the staged combustion process, which is employed for $NO_x$ control in the integrated low $NO_x$ tangential firing system 12 constructed in accordance with the present invention. Finer solid fuel can result in close ignition at the discharge tip of the fuel nozzle 58, thereby enhancing fuel-bound nitrogen release and its subsequent reduction to $N_2$ under staged conditions. Secondary benefits include fewer large (>100 mesh) particles impinging on the waterwalls of the pulverized solid fuel-fired furnace 10 and improved low-load ignition stability. From the pulverizer 64, the pulverized solid fuel having the finenesses enumerated hereinabove are transported through the pulverized solid fuel ducts 66 from the pulverizer 64 to which the pulverized solid fuel ducts 66 are connected in fluid flow relation on the one hand to the fuel nozzles 58 supported in mounted relation within the fuel compartments 48, 50, 52, 54 and 56 to which on the other hand the pulverized solid fuel ducts 66 are connected in fluid flow relation through separate valves and controls (not shown). Although not shown in the interest of maintaining clarity of illustration in the drawing, the pulverizer 44 is operatively connected to the fan (not shown) of the air supply means, to which reference has been had hereinbefore, such that air is also supplied from the fan (not shown) of the air supply means to the pulverizer 64 whereby the pulverized solid fuel supplied from the pulverizer 64 to the fuel nozzles 58 supported in mounted relation within the fuel compartments 48, 50, 52, 54 and 56 is transported through the pulverized solid fuel ducts 66 in an air stream in a manner which is well-known to those skilled in the art of pulverizers.

Figure 4:
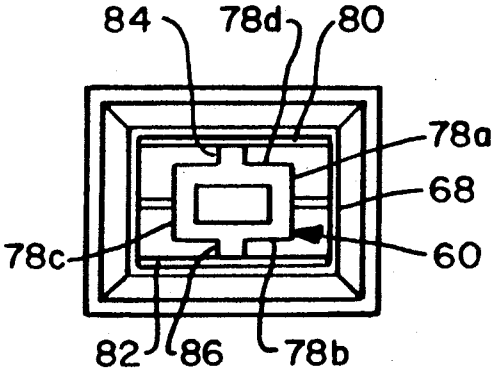
FIG. 4 is an end view of the pulverized solid fuel nozzle embodying a flame attachment tip that is depicted in FIG. 3 and which is employed in an integrated low $NO_x$ tangential firing system constructed in accordance with the present invention.

With further reference to the flame attachment pulverized solid fuel nozzle tip 60 depicted in FIG. 4 of the drawing, the principal function thereof is to effect the ignition of the pulverized solid fuel being injected therefrom into the burner region 14 of the pulverized solid fuel-fired furnace 10 at a point in closer proximity, i.e., within two feet thereof, than that at which it has been possible to effect ignition heretofore with prior art forms of pulverized solid fuel nozzle tips. This rapid ignition of the pulverized solid fuel produces a stable volatile matter flame and concomitantly minimizes $NO_x$ production in the pulverized solid fuel-rich stream. The unique feature of the flame attachment pulverized solid fuel nozzle tip 60 resides in the bluff-body lattice structure denoted by the reference numeral 68 in FIG. 4, which is provided at the discharge end thereof. This lattice structure 68 changes the characteristics of the pulverized solid fuel/air stream, which is being discharged from the flame attachment pulverized solid fuel nozzle tip 60, from principally laminar flow to turbulent flow. The increased turbulence in the pulverized solid fuel/air stream increases the dynamic flame propagation speed and combustion intensity. This in turn results in rapid ignition of the entire pulverized solid fuel/air jet (close to the flame attachment pulverized solid fuel nozzle tip 60 but not attached thereto), higher early flame temperature (maximize volatile matter release including fuel nitrogen) and rapid consumption of available oxygen (minimize early NO formation). The real benefit and commercial significance of the flame attachment pulverized solid fuel nozzle tip 60 is its ability to provide excellent performance without having an attached flame. Experience has shown that prior art forms of flame attachment nozzle tips can suffer premature failure and/or pluggage problems when firing certain pulverized solid fuels. Since the flame attachment pulverized solid fuel nozzle tip 60 can maintain a stable detached flame, it is deemed to be capable of obviating the pluggage/rapid burn-up problems, which have served to disadvantageously characterize the prior art forms of flame attachment nozzle tips that have been employed heretofore.

Figure 3:
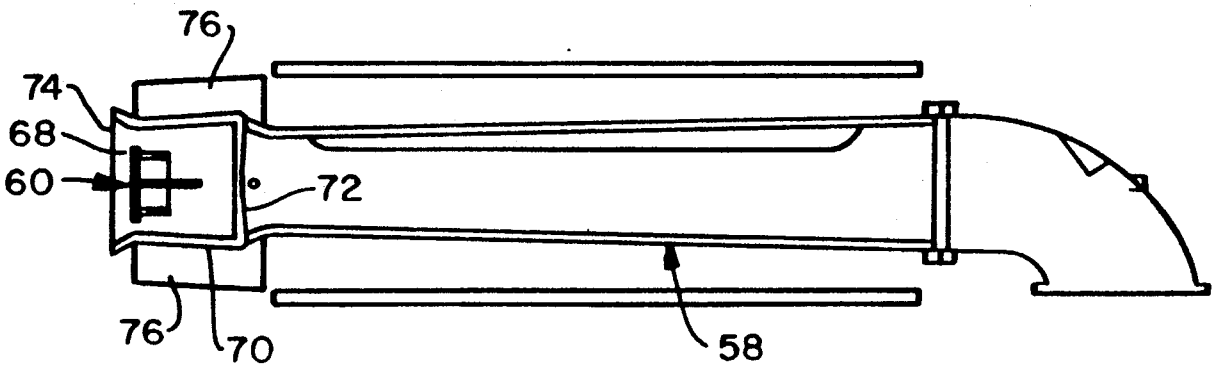
FIG. 3 is a side elevational view of a pulverized solid fuel nozzle embodying a flame attachment tip that is employed in an integrated low $NO_x$ tangential firing system constructed in accordance with the present invention.

As best understood with reference to FIGS. 3 and 4 of the drawing, the flame attachment pulverized solid fuel nozzle tip 60 is configured in the nature of a generally rectangular shaped box, denoted in FIG. 3 by the reference numeral 70. The rectangular shaped box 70 has open ends, seen at 72 and 74 in FIG. 3, at opposite sides thereof through which the pulverized solid fuel/-primary air stream enters and exits, respectively, the flame attachment pulverized solid fuel nozzle tip 60. Surrounding the rectangular shaped box 70 at a small distance away therefrom is a passageway, seen at 76 in FIG. 3, for additional air, i.e., combustion supporting air. The unique features of the flame attachment pulverized solid fuel nozzle tip 60 are deemed to be its exit features. To this end, there are four rectangular bars, denoted by the reference numerals 78*a*, 78*b*, 78*c* and 78*d* in FIG. 4, that are supported in mounted relation within the rectangular shaped box 70 through the use of any conventional form of mounting means (not shown) suitable for use for such a purpose such that the rectangular bars 78*a*, 78*b*, 78*c* and 78*d* are located symmetrically about the axes and center of the exit plane of the flame attachment pulverized solid fuel nozzle tip 60. Also in the exit plane of the flame attachment pulverized solid fuel nozzle tip 60 are "shear bars", denoted by the reference numerals 80 and 82 in FIG. 4, that are supported in mounted relation within the rectangular shaped box 70 through the use of any conventional form of mounting means (not shown) suitable for use for such a purpose so as to be located at the top and have been employed heretofore.

As best understood with reference to FIGS. 3 and 4 of the drawing, the flame attachment pulverized solid fuel nozzle tip 60 is configured in the nature of a generally rectangular shaped box, denoted in FIG. 3 by the reference numeral 70. The rectangular shaped box 70 has open ends, seen at 72 and 74 in FIG. 3, at opposite sides thereof through which the pulverized solid fuel/-primary air stream enters and exits, respectively, the flame attachment pulverized solid fuel nozzle tip 60. Surrounding the rectangular shaped box 70 at a small distance away therefrom is a passageway, seen at 76 in FIG. 3, for additional air, i.e., combustion supporting air. The unique features of the flame attachment pulverized solid fuel nozzle tip 60 are deemed to be its exit features. To this end, there are four rectangular bars, denoted by the reference numerals 78*a*, 78*b*, 78*c* and 78*d* in FIG. 4, that are supported in mounted relation within the rectangular shaped box 70 through the use of any conventional form of mounting means (not shown)

suitable for use for such a purpose such that the rectangular bars 78*a*, 78*b*, 78*c* and 78*d* are located symmetrically about the axes and center of the exit plane of the flame attachment pulverized solid fuel nozzle tip 60. Also in the exit plane of the flame attachment pulverized solid fuel nozzle tip 60 are "shear bars", denoted by the reference numerals 80 and 82 in FIG. 4, that are supported in mounted relation within the rectangular shaped box 70 through the use of any conventional form of mounting means (not shown) suitable for use for such a purpose so as to be located at the top and bottom, respectively, of the exit plane of the flame attachment pulverized solid fuel nozzle tip 60. The four rectangular bars 78*a*, 78*b*, 78*c* and 78*d* are attached to the "shear bars" 80 and 82 by short rectangular bar pieces seen at 84 and 86 in FIG. 4 of the drawing. The exact dimensions of the rectangular shaped box 70, and of the rectangular bars 78*a*; 78*b*, 78*c* and 78*d* and "shear bars" 80 and 82, both of which are supported in mounted relation within the rectangular shaped box 70, are all established based on the firing rate that the fuel nozzle 58 is designed to have.

Continuing with the description of the flame attachment pulverized solid fuel nozzle tip 60, the rectangular bars 78*a*, 78*b*, 78*c* and 78*d* create turbulence when the pulverized solid fuel and primary air exit at 74 from the rectangular shaped box 70. This has several beneficial effects. Namely, turbulence creates eddies where the flame propagation speed is faster than the pulverized solid fuel/primary air velocity thereby permitting ignition points closer to the exit from the flame attachment pulverized solid fuel nozzle tip, i.e., within two feet thereof. In addition, the relative velocities of the pulverized solid fuel and primary air are different, which increases mixing, and, therefore, pulverized solid fuel devolatilization in the near field of the fuel nozzle 58. Both of these effects help decrease the production of $NO_x$ by driving off volatiles in an oxygen deficient zone, which is known to be effective to reduce the amount of $NO_x$ produced by pulverized solid fuel nitrogen conversion.

With further reference thereto, the main windbox 20, in accordance with the illustration thereof in FIG. 2 of the drawing, is provided within an auxiliary fuel compartment, denoted generally by the reference numeral 88 in FIG. 2. The auxiliary fuel compartment 88 is operative to effect by means of an auxiliary fuel nozzle suitably provided therein the injection therethrough into the burner region 14 of the pulverized solid fuel-fired furnace 10 of auxiliary fuel, which is in the form of non-pulverized solid fuel, i.e., oil or gas, when such injection thereof is deemed to be desirable. For example, it may be deemed to be desirable to effect such injection of auxiliary fuel while the pulverized solid fuel-fired furnace 10 is undergoing start-up. Although the main windbox 20 is illustrated in FIG. 2 as embodying only one such auxiliary fuel compartment 88, it is to be understood that the main windbox 22 could also be provided with additional auxiliary air compartments 88 without departing from the essence of the present invention. To this end, if it were desired to provide additional auxiliary fuel compartments 88 such could be accomplished by replacing one or more of the straight air compartments 26, 28 and 30 with an auxiliary fuel compartment 88.

Figure 5:
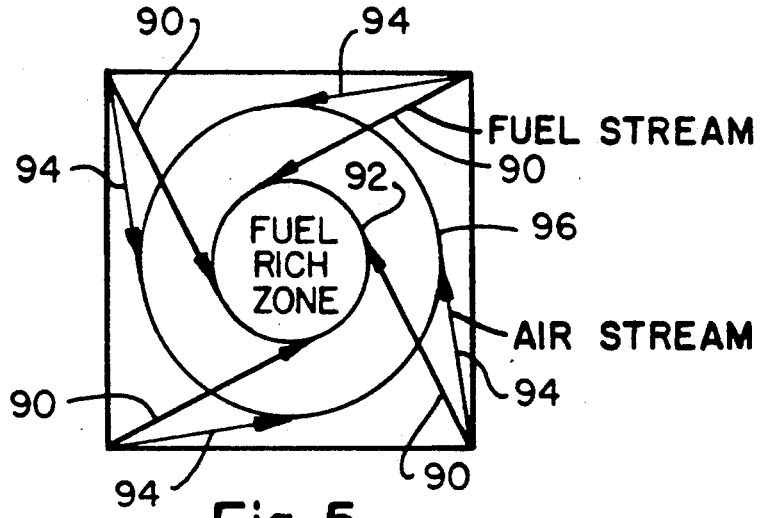
FIG. 5 is a plan view of a firing circle depicting the principle of operation of the offset firing that is employed in an integrated low $NO_x$ tangential firing system constructed in accordance with the present invention.

A discussion will next be had herein of the principle of operation of offset firing. For this purpose, reference will be had in particular to FIG. 5 of the drawing. As best understood with reference to FIG. 5, the pulverized solid fuel and primary air stream that is injected into the burner region 14 of the pulverized solid fuel-fired furnace 10 through the pulverized solid fuel compartments 48, 50, 52, 54 and 56 is directed, as schematically depicted at 90 in FIG. 5, towards the imaginary small circle denoted in FIG. 5 by the reference numeral 92, which is centrally located within the burner region 14 of the pulverized solid fuel-fired furnace 10. In contradistinction to the pulverized solid fuel and primary air stream, the combustion supporting air, i.e., secondary air, that is being injected into the burner region 14 of the pulverized solid fuel-fired furnace 10 through the offset air compartments 32, 34, 36, 38, 40, 42, 44 and 46 is directed, as schematically depicted at 94 in FIG. 5, towards the imaginary larger diameter circle denoted by the reference numeral 96, which by virtue of being concentric to the small circle 92 necessarily is like the small circle 92 also centrally located within the burner region 14 of the pulverized solid fuel-fired furnace 10.

Horizontally offsetting some of the secondary airflow through the main windbox 20 makes less air available to the pulverized solid fuel and primary air stream during the early stages of combustion. It also creates an oxidizing environment near the waterwalls of the pulverized solid fuel-fired furnace 10 in and above the firing zone of the pulverized solid fuel and primary air. This has the effect of reducing ash deposition quantity and tenacity and results in both less usage of the wall blowers and increased heat absorption in the lower portion of the pulverized solid fuel-fired furnace 10. Increased $O_2$ levels along the waterwalls of the pulverized solid fuel-fired furnace 10 also reduce corrosion potential, especially when pulverized solid fuels with high concentrations of sulfur, iron, or alkali metals (K, Na) are fired. Corrosion by sulfidation or other mechanism(s) can be largely controlled in practice by minimizing the potential for direct impingement of the pulverized solid fuel and primary air stream on the waterwalls of the pulverized solid fuel-fired furnace 10. This potential is addressed via conservative heat release parameters and geometries of the pulverized solid fuel-fired furnace 10, as well as improved control of the fineness of the pulverized solid fuel being combusted within the pulverized solid fuel-fired furnace 10.

Continuing with the description of the integrated $NO_x$ tangential firing system 12, in accord with the illustrated embodiment thereof in FIG. 2 of the drawing a pair of close coupled overfire air compartments, denoted generally by the reference numerals 98 and 100, respectively, in FIG. 2 of the drawing, is provided in the main windbox 20 within the upper portion thereof such as to be located substantially in juxtaposed relation to the end air compartment 24. A close coupled overfire air nozzle is supported in mounted relation through the use of any conventional form of mounting means (not shown) suitable for use for such a purpose within each of the close coupled overfire air compartments 98 and 100. Each of the close coupled overfire air compartments 98 and 100 is operatively connected to the same air supply means (not shown) to which, as has been described herein previously, each of the end air compartments 22 and 24 as well as each of the straight air compartments 26, 28 and 30 and each of the offset air compartments 32, 34, 36, 38, 40, 42, 44 and 46 is operatively connected such that this air supply means (not shown) supplies some of the combustion supporting air to each of the close coupled overfire air compartments 98 and 100 for injection therethrough into the burner region 14 of the pulverized solid fuel-fired furnace 10. The injection of such combustion supporting air through the close coupled overfire air compartments 98 and 100 has the effect of improving carbon burnout without increasing $NO_x$ production.

With further regard to the nature of the construction of the integrated low $NO_x$ tangential firing system 12, two or more discrete levels of separated overfire air are incorporated in each corner of the pulverized solid fuel-fired furnace 10 so as to be located between the top of the main windbox 20 and the furnace outlet plane, depicted by the dotted line 102 in FIG. 1, of the pulverized solid fuel-fired furnace 10. In accordance with the embodiment thereof illustrated in FIGS. 1 and 2 of the drawing, the integrated low $NO_x$ tangential firing system 12 embodies two discrete levels of separated overfire air, i.e., a low level of separated overfire air denoted generally in FIGS. 1 and 2 of the drawing by the reference numeral 104 and a high level of separated overfire air denoted generally in FIGS. 1 and 2 of the drawing by the reference numeral 106. The low level 104 of separated overfire air is suitably supported through the use of any conventional form of support means (not shown) suitable for use for such a purpose within the burner region 14 of the pulverized solid fuel-fired furnace 10 so as to be suitably spaced from the top of the windbox 20, and more specifically from the top of the close coupled overfire air compartment 100 thereof, and so as to be substantially aligned with the longitudinal axis of the main windbox 20. Similarly, the high level 106 of separated overfire air is suitably supported through the use of any conventional form of support means (not shown) suitable for use for such a purpose within the burner region 14 of the pulverized solid fuel-fired furnace 10 so as to be suitably spaced from the low level 104 of separated overfire air, and so as to be substantially aligned with the longitudinal axis of the main windbox 20. The low level 104 of separated overfire air and the high level 106 of separated overfire air are suitably located between the top of the main windbox 20 and the furnace outlet plane 102 such that the time that it takes for the gases generated from the combustion of the pulverized solid fuel to travel from the top of the main windbox 20 to the top of the high level 106 of separated overfire air, i.e., the residence time, exceeds 0.3 seconds.

Figure 6:
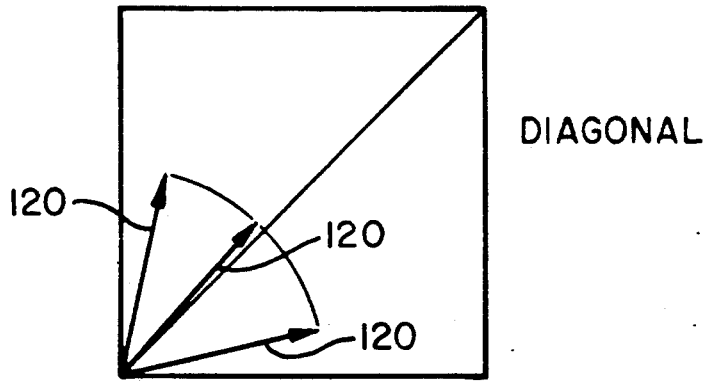
FIG. 6 is a plan view of a pulverized solid fuel-fired furnace embodying an integrated low $NO_x$ tangential firing system constructed in accordance with the present invention depicting the principle of operation of the adjustable yaw of the separated overfire air that is employed in the integrated low $NO_x$ tangential firing system.
Figure 7:
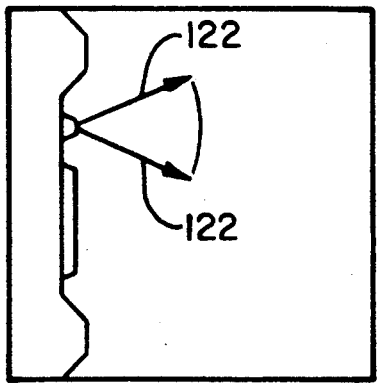
FIG. 7 is a side elevational view of a pulverized solid fuel-fired furnace embodying an integrated low $NO_x$ tangential firing system constructed in accordance with the present invention depicting the principle of operation of the adjustable tilting of the separated overfire air that is employed in the integrated low $NO_x$ tangential firing system.

Continuing with the description of the low level 104 of separated overfire air and the high level 106 of separated overfire air, in accordance with the embodiment thereof illustrated in FIGS. 1 and 2 of the drawing the low level 104 of separated overfire air embodies three separated overfire air compartments denoted by the reference numerals 108, 110 and 112 in FIG. 2 of the drawing. Similarly, the high level 106 of separated overfire air also embodies three separated overfire air compartments denoted by the reference numerals 114, 116 and 118 in FIG. 2 of the drawing. A separated overfire air nozzle is supported in mounted relation through the use of any conventional form of mounting means (not shown) suitable for use for such a purpose in each of the separated overfire air compartments 108, 110 and 112 of the low level 104 of separated overfire air and in each of the separated overfire air compartments 114, 116 and 118 of the high level 106 of separated overfire air such that each of such separated overfire air nozzles is capable of both yaw movement and tilting movement. As best understood with reference to FIG. 6 of the drawing, yaw movement is intended to refer to movement in a horizontal plane, i.e., movement in the manner of the arrow denoted by the reference numeral 120 in FIG. 6. On the other hand, tilting movement as best understood with reference to FIG. 7 of the drawing is intended to refer to movement in a vertical plane, i.e., movement in the manner of the arrow denoted by the reference numeral 122 in FIG. 7.

Completing the description of the low level 104 of separated overfire air and of the high level 106 of separated overfire air, each of the separated overfire air compartments 108, 110 and 112 of the low level 104 of separated overfire air is operatively connected in fluid flow relation to the same air supply means (not shown) to which, as has been described herein previously, each of the end air compartments 22 and 24, each of the straight air compartments 26, 28 and 30, each of the offset air compartments 32, 34, 36, 38, 40, 42, 44 and 46, and each of the close coupled overfire air compartments 98 and 100 is operatively connected such that this air supply means (not shown) supplies some of the combustion supporting air to each of the separated overfire air compartments 108, 110 and 112 for injection therethrough into the burner region 14 of the pulverized solid fuel-fired furnace 10. Likewise, each of the separated overfire air compartments 114, 116 and 118 of the high level 106 of separated overfire air is operatively connected in fluid flow relation to the same air supply means (not shown) to which, as has been described herein previously, each of the end air compartments 22 and 24, each of the straight air compartments 26, 28 and 30, each of the offset air compartments 32, 34, 36, 38, 40, 42, 44 and 46, and each of the close coupled overfire air compartments 98 and 100 is operatively connected such that this air supply means (not shown) supplies some of the combustion supporting air to each of the separated overfire air compartments 114, 116 and 118 for injection therethrough into the burner region 14 of the pulverized solid fuel-fired furnace 10.

The effect of employing multi-staged separate overfire air, i.e., two or more discrete levels of separated overfire air, is that it permits the stoichiometry within the burner region 14 of the pulverized solid fuel-fired furnace 10 to be optimized for $NO_x$ control for each given pulverized solid fuel. Moreover, by utilizing the yaw and tilt positioning capability of the separated overfired air compartments 108, 110 and 112 of the low level 104 of separated overfire air and of the separated overfire air compartments 114, 116 and 118 of the high level 106 of separated overfire air, it is possible by virtue thereof to effect tuning of the combustion air and furnace gas mixing process for maximum control of combustible emissions such as carbon, CO, total hydrocarbons (THC) and polycyclic aromatic compounds (PAC).

A brief description will now be set forth herein of the mode of operation of the integrated low $NO_x$ tangential firing system 12 constructed in accordance with the present invention, which is designed to be employed in a pulverized solid fuel-fired furnace, such as the pulverized solid fuel-fired furnace 10 illustrated in FIG. 1 of the drawing, and when so employed therein the integrated low $NO_x$ tangential firing system 12 is operative for limiting the $NO_x$ emission from the pulverized solid fuel-fired furnace 10 to less than 0.15 lb./$10^6$ BTU, while yet at the same time the carbon-in-flyash from the pulverized solid fuel-fired furnace 10 is limited to less than 5% and the CO emissions from the pulverized solid fuel-fired furnace 10 are limited to less than 50 ppm. To this end, in accordance with the mode of operation of the integrated low $NO_x$ tangential firing system 12 there is supplied from the pulverizer 64 pulverized solid fuel having fineness levels of approximately 0% on a 50-mesh sieve, 1.5% on a 100-mesh sieve and more than 85% passing through a 200-mesh sieve wherein 50-mesh, 100-mesh and 200-mesh are equivalent to particle sizes of approximately 300 microns, 150 microns and 74 microns, respectively. The pulverized solid fuel having the fineness levels enumerated above are transported in an air stream through the fuel ducts 66 from the pulverizer 64 to the pulverized solid fuel compartments 48, 50, 52, 54 and 56. The pulverized solid fuel, while still entrained in an air stream is then injected into the burner region 14 of the pulverized solid fuel-fired furnace 10 through the flame attachment pulverized solid fuel nozzle tip 6 that is suitably provided for this purpose in each of the pulverized solid fuel compartments 48, 50, 52, 54 and 56 whereby the ignition point of the pulverized solid fuel that is injected therethrough occurs within less than two feet of the respective one of the flame attachment pulverized solid fuel nozzle tip 60 through which the pulverized solid fuel has been injected, thereby producing a stable volatile matter flame and minimizing $NO_x$ production in the pulverized solid fuel-rich stream.

Continuing with the description of the mode of operation of the integrated low $NO_x$ tangential firing system 12, a preestablished amount of combustion supporting air in the form of secondary air is injected into the burner region 14 of the pulverized solid fuel-fired furnace 10 through each of the end air compartments 22 and 24, each of the straight air compartments 26, 28 and 30, and each of the offset air compartments 32, 34, 36, 38, 40, 42, 44 and 46 such that the stoichiometry, which exists within the burner region 14 of the pulverized solid fuel-fired furnace 10 and more specifically within the primary combustion zone thereof, is between 0.5 and 0.7. The term stoichiometry, as employed herein, is defined to mean the theoretical amount of air that is required to complete the combustion of the pulverized solid fuel, and the term primary combustion zone, as employed herein, is defined to mean the zone lying between the end air compartment 22 and the end air compartment 24. The effect of the stoichiometry being between 0.5 and 0.7 in the primary combustion zone is that the release of nitrogen from the pulverized solid fuel, which has been injected thereinto through the pulverized solid fuel compartments 48, 50, 52, 54 and 56, and the conversion of this nitrogen to molecular nitrogen, i.e., $N_2$, is maximized. An additional effect is that the carryover of total atomic nitrogen species, i.e., NO, HCN, $NH_3$ and char-nitrogen, from the primary combustion zone to the next zone within the burner region 14 of the pulverized solid fuel-fired furnace 10 is minimized.

In addition to the combustion supporting air that as has been described hereinbefore is injected into the primary combustion zone, a preestablished amount of combustion supporting air in the form of close coupled overfire air is injected into the burner region 14 of the pulverized solid fuel-fired furnace 10 through each of the close coupled overfire air compartments 98 and 100 such that the stoichiometry, which exists within the burner region 14 of the pulverized solid fuel-fired furnace 10 and more specifically within the pseudo-reburn/de$NO_x$ zone thereof is between 0.7 and 0.9. The term pseudo-reburn/de$NO_x$ zone, as employed herein, is defined to mean the zone lying between the close coupled overfire air compartment 100 and the separated overfire air compartment 108 of the low level 104 of separated overfire air. The effect of the stoichiometry being between 0.7 and 0.9 in the pseudo-reburn/de$NO_x$ zone is that the reduction of NO to $N_2$ through reaction with hydrocarbons and/or amine radicals is maximized.

With further reference to the mode of operation of the integrated low $NO_x$ tangential firing system 12 constructed in accordance with the present invention, a preestablished amount of combustion supporting air in the form of separated overfire air is injected into the burner region 14 of the pulverized solid fuel-fired furnace 12. More specifically, a first preestablished amount of such combustion supporting air in the form of separated overfire air is injected into the burner region 14 of the pulverized solid fuel-fired furnace 10 through each of the separated overfire air compartments 108, 110 and 112 of the low level 104 of separated overfire air such that the stoichiometry, which exists within the burner region 14 of the pulverized solid fuel-fired furnace 10 and more specifically within the reactive nitrogen depletion zone thereof, is between 0.9 and 1.02. The term reactive nitrogen depletion zone, as employed herein, is defined to mean the zone lying between the separated overfire air compartment 112 of the low level 104 of separated overfire air and the separated overfire air compartment 114 of the high level 106 of separated overfire air. The effect of the stoichiometry being between 0.9 and 1.02 in the reactive nitrogen depletion zone is that carryover of reactive nitrogen species (i.e., $NH_3$, HCN and char-nitrogen) to the final zone within the burner region 14 of the pulverized solid fuel-fired furnace 10 is minimized, while at the same time conversion to molecular nitrogen ($N_2$) is maximized.

A second preestablished amount of such combustion supporting air in the form of separated overfire air is injected into the burner region 14 of the pulverized solid fuel-fired furnace 10 through each of the separated overfire air compartments 114, 116 and 118 of the high level 106 of separated overfire air such that the stoichiometry, which exists within the burner region 14 of the pulverized solid fuel-fired furnace 10 and more specifically within the final/burnout zone thereof, is at least 1.07. The term final/burnout zone, as employed herein, is defined to mean the zone lying between the separated overfire air compartment 118 of the high level 106 of separated overfire air and the furnace outlet plane 102. The effect of the stoichiometry being at least 1.07 in the final/burnout zone is to raise the stoichiometry to the final emission air level in order to minimize emission of CO, THC/VOC and unburned quality, while yet minimizing any thermal $NO_x$ formation.

To thus summarize, the integrated low $NO_x$ tangential firing system 12, as constructed in accordance with the present invention, embodies a number of concepts. For example, an optimum primary firing zone stoichiometry exists within the integrated low $NO_x$ tangential firing system wherein the stoichiometry is between 0.5 and 0.7. Secondly, in accord with the mode of operation of the integrated low $NO_x$ tangential firing system 12 an optimum mass flow percentage of air is injected at each given overfire air level in order to achieve minimum $NO_x$ formation, i.e., maximize $NO_x$ reduction, and/or maximum combustion efficiency. This optimum mass flow percentage is considered to be in the 10% to 20% range. Thirdly, there are as many as four important reaction steps in the overall combustion $NO_x$ formation/destruction process. Each reaction step has its own particular optimum conditions including stoichiometry. As has been described hereinbefore, the zones in which these four reaction steps take place are as follows: the primary combustion zone wherein the stoichiometry is between 0.5 and 0.7, the pseudoreburn/de$NO_x$ zone wherein the stoichiometry is between 0.7 and 0.9, the reactive nitrogen depletion zone wherein the stoichiometry is between 0.9 and 1.02, and the final/burnout zone wherein the stoichiometry is at least 1.07. Finally, in accord with the nature of the construction of the integrated low $NO_x$ tangential firing system 12 the multistaged separated overfire air is designed to be injected into the pulverized solid fuel-fired furnace 10 through separated overfire air compartments, e.g., the separated overfire air compartments 108, 110 and 112 of the low level 104 of separated overfire air and the separated overfire air compartments 114, 116 and 118 of the high level 106 of separated overfire air, at two or more discrete levels, which are located between the top of the main windbox 20 and the furnace outlet plane 102 of the pulverized solid fuel-fired furnace 10 such that the residence time exceeds 0.3 seconds, i.e., the time that it takes for the gases generated from the combustion of the pulverized solid fuel to travel from the top of the main windbox 20 to the top of the last level of separated overfire air, which in accord with the embodiment of the integrated low $NO_x$ tangential firing system 12 depicted in FIGS. 1 and 2 of the drawing is the top of the separated overfire air compartment 118 of the high level 106 of separated overfire air.

Three types of pulverized solid fuels, hereinafter referred to as A, B and C, were selected as being representative of Eastern United States pulverized solid fuels, and were utilized in the development of the integrated low $NO_x$ tangential firing system 12 constructed in accordance with the present invention. Analyses of these three types of pulverized solid fuels are set forth below:

| Pulverized Solid Fuel Type | A | B | C |
|---|---|---|---|
| HHV(Btu/lb) | 13,060 | 13,137 | 12,374 |
| FC/VM | 2.2 | 1.6 | 1.2 |
| Moisture (wt. %) | 4.2 | 5.1 | 7.0 |
| N (wt. %) | 1.1 | 1.3 | 0.9 |
| S (wt. %) | 0.8 | 1.3 | 3.6 |
| Ash (wt. %) | 9.7 | 8.4 | 8.0 |

Eastern United States pulverized solid fuels were selected because they are typically less amenable to staged combustion, particularly when striving simultaneously for both low $NO_x$ emissions and low unburned carbon-in-flyash. The ASTM classifications for the tested pulverized solid fuel are: medium volatile bituminous for pulverized solid fuel A and high volatile bituminous for both pulverized solid fuel B and pulverized solid fuel C.

Figure 8:
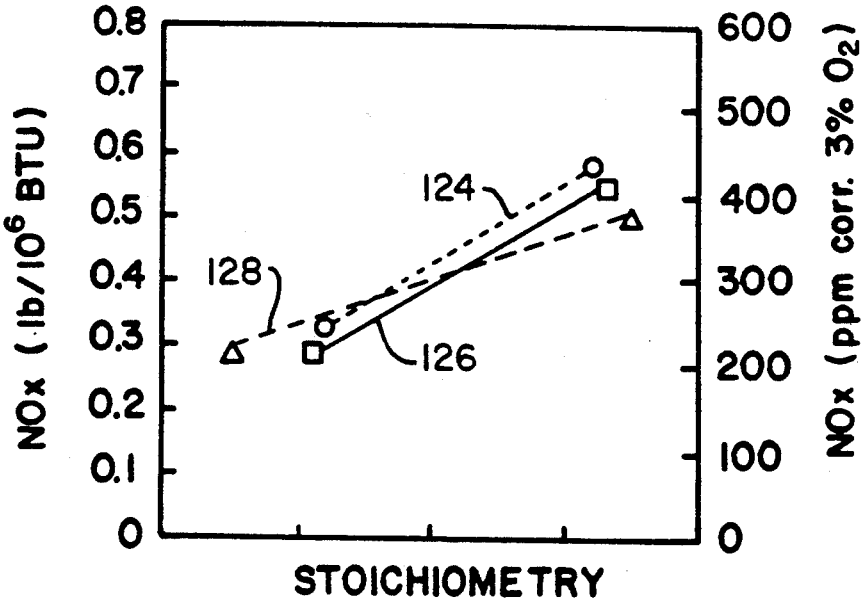
FIG. 8 is a graphical depiction of the comparison of $NO_x$ emission levels obtained in two field tests and one lab test of a prior art form of low $NO_x$ firing system suitable for embodiment in a pulverized solid fuel-fired furnace.

The lab facilities, which were employed in the development of the integrated low $NO_x$ tangential firing system 12, essentially duplicates all major aspects of a typical tangentially-fired pulverized solid fuel furnace, including the lower furnace, the ash hopper, multiple burners, the arch section, superheater and/or reheater panels, and convective heat transfer surfaces. The aforementioned lab facilities have heretofore demonstrated the ability to generate $NO_x$ emissions levels consistent with measurements obtained from actual tangentially-fired pulverized solid fuel furnaces. By way of exemplification and not limitation in this regard, reference can be had to FIG. 8 of the drawing, which constitutes a graphical depiction of the comparison of $NO_x$ emission levels obtained in two field tests from an actual tangentially-fired pulverized solid fuel furnace and one lab test, employing the aforereferenced lab facilities, of a prior art form of low $NO_x$ firing system suitable for embodiment in a tangentially-fired pulverized solid fuel furnace. The field tests are denoted by the reference numerals 124 and 126, respectively, in FIG. 8, whereas the lab test is denoted by he reference numeral 128 in FIG. 8.

Figure 9:
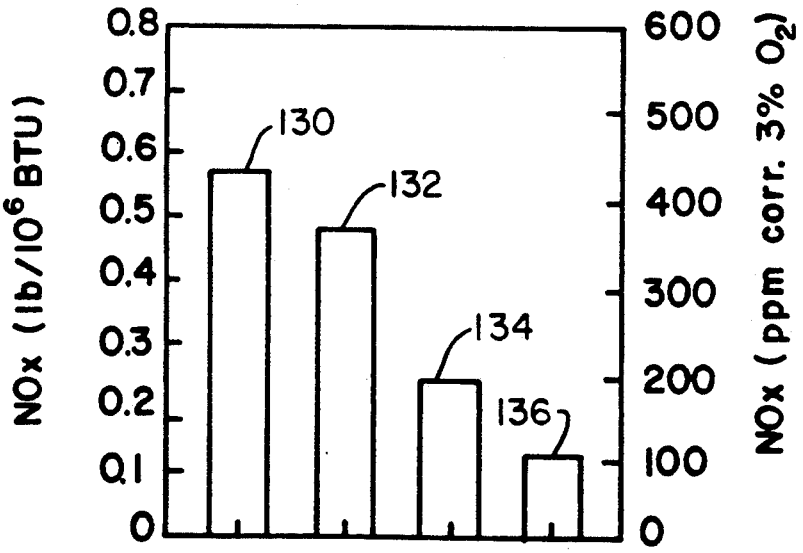
FIG. 9 is a graphical depiction of the comparison of $NO_x$ emission levels obtained both from prior art forms of low $NO_x$ firing systems each suitable for embodiment in a pulverized solid fuel-fired furnace and from an integrated low $NO_x$ tangential firing system constructed in accordance with the present invention.

Reference will next be had to FIG. 9 of the drawing, which constitutes a graphical depiction of the comparison of $NO_x$ emission levels obtained from various prior art forms of low $NO_x$ firing systems each suitable for embodiment in a pulverized solid fuel-fired furnace and from an integrated low $NO_x$ tangential firing system 12 constructed in accordance with the present invention. The $NO_x$ emission levels achieved with these various prior art forms of low $NO_x$ firing systems are denoted in FIG. 9 by the reference numerals 130, 132 and 134, whereas the $NO_x$ emission level achieved with the integrated low $NO_x$ tangential firing system 12 is denoted by the reference numeral 136 in FIG. 9. It can be seen, by way of exemplification and not limitation from FIG. 9, that the $NO_x$ emission reduction achieved with the prior art form of low $NO_x$ firing system that produced the $NO_x$ emission level denoted by the reference numeral 134 in FIG. 9 is approximately 50% less than that achieved with the prior art form of low $NO_x$ firing system that produced the $NO_x$ emission level denoted by the reference numeral 130 in FIG. 9. Moreover, the performance attainable with the integrated low $NO_x$ tangential system 12 constructed in accordance with the present invention represents an even further improvement relative to that achievable with the prior art form of low $NO_x$ firing system that produced the $NO_x$ emission level denoted by the reference numeral 130 in FIG. 9. Namely, with the integrated low $NO_x$ tangential firing system 12 it is possible, as seen at 136 in FIG. 9, to attain a $NO_x$ emission reduction of almost 80% over that attainable with the prior art form of low $NO_x$ firing system that produced the $NO_x$ emission level depicted at 130 in FIG. 9. To this end, $NO_x$ emissions as low as 0.14 lb./$10^6$ BTU have been attained in lab tests with the integrated low $NO_x$ tangential firing system 12 constructed in accordance with the present invention when firing Eastern United States pulverized solid fuel A.

Figure 10:
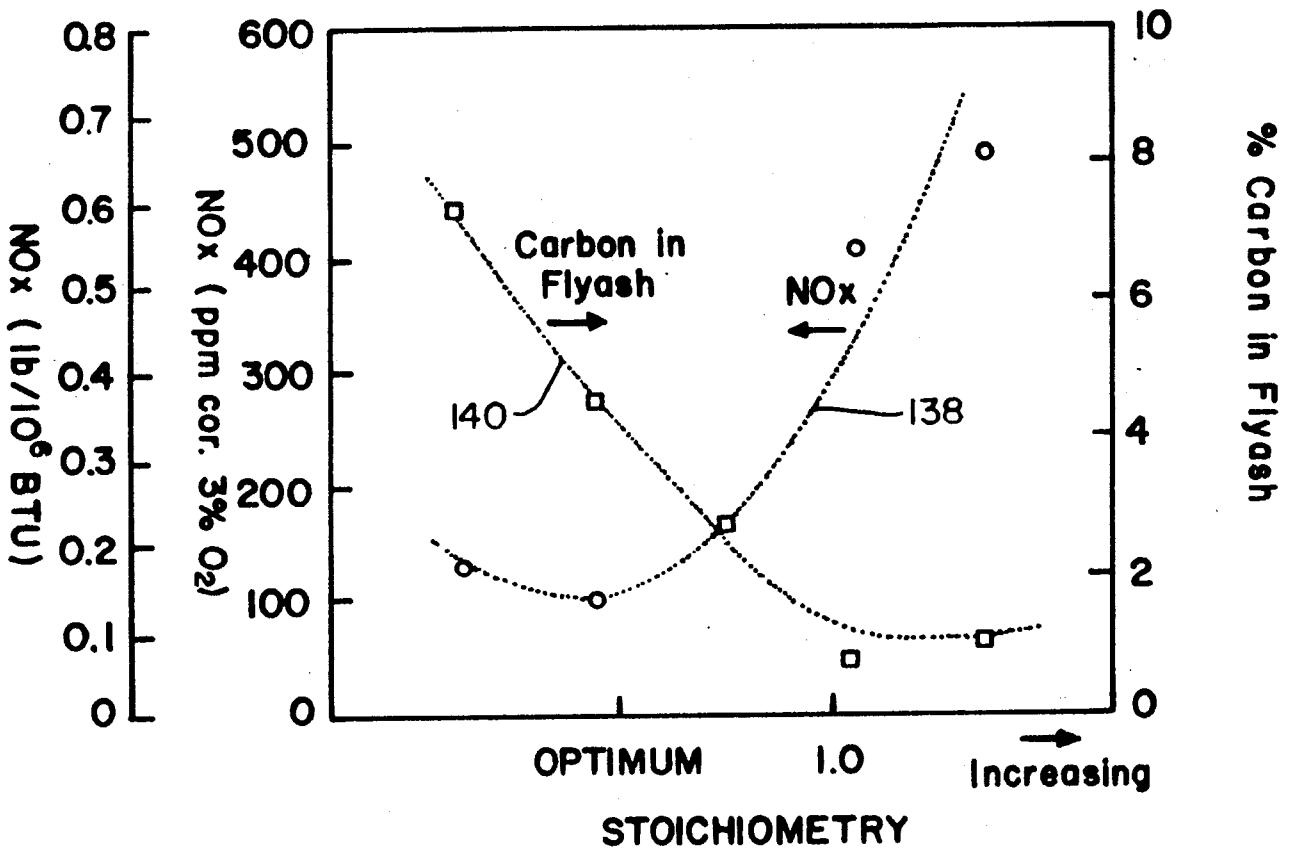
FIG. 10 is a graphical depiction of the effect on both $NO_x$ emission levels and on the amount of carbon-in-flyash as the stoichiometry is reduced in the main burner zone of a pulverized solid fuel-fired furnace that embodies an integrated low $NO_x$ tangential firing system constructed in accordance with the present invention.

With pulverized solid fuel firing, $NO_x$ emissions are strongly influenced by oxygen availability in the early stages of combustion. The availability of oxygen in the early, global stage of the tangential firing process is characterized by the parameter "main burner zone stoichiometry" (the ratio of oxygen available to that required for complete fuel oxidation in the lower furnace region defined theoretically by the zone of fuel introduction). FIG. 10 shows that as main burner zone stoichiometry is reduced to optimum levels, $NO_x$ emissions, depicted by the line denoted by the reference numeral 138 in FIG. 10, are dramatically decreased to 0.14 lb./$10^6$ BTU. FIG. 10 also shows that unburned carbon emissions, depicted by the line denoted by the reference numeral 140 in FIG. 10, increase with reduced stoichiometry, but are within the goal of less than 5% carbon-in-flyash. As can be seen from FIG. 10, further reductions in main burner zone stoichiometric levels below the optimum result in increases in both unburned carbon and $NO_x$ emissions.

Figure 11:
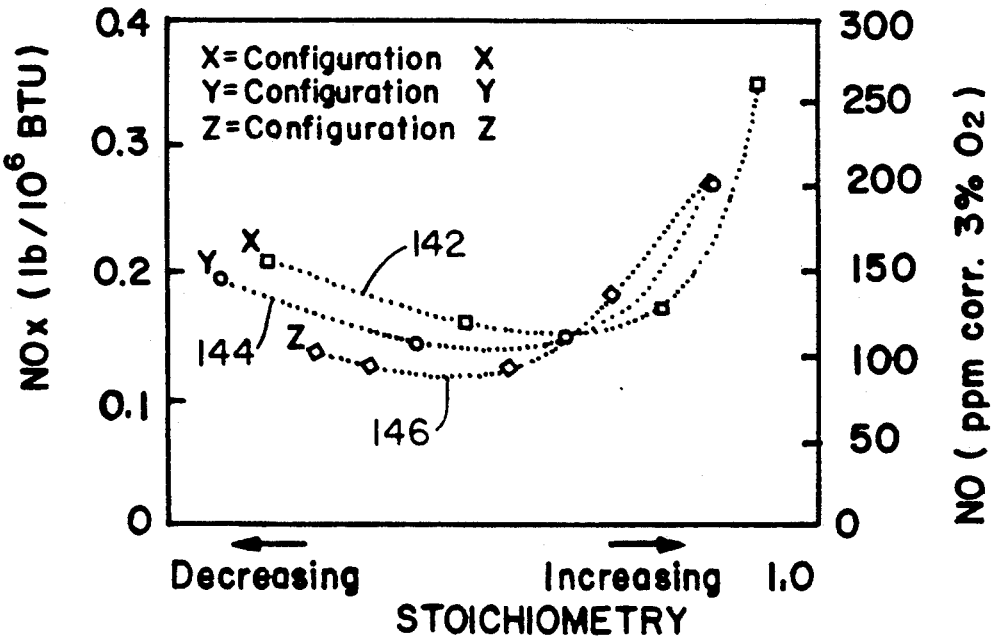
FIG. 11 is a graphical depiction of the effect that stoichiometry has on $NO_x$ emission levels when three differently configured forms of low $NO_x$ firing systems, each suitable for embodiment in a pulverized solid fuel-fired furnace, are employed.

FIG. 11 indicates that low $NO_x$ emission levels are not achieved only by bulk furnace staging at low stoichiometric levels. In FIG. 11, the $NO_x$ emission results, depicted therein by the lines denoted by the reference numerals 142, 144 and 146, respectively, attained from three differently configured forms of low $NO_x$ firing systems during tests conducted therewith when firing Eastern United States pulverized solid fuel A are shown as a function of the main burner zone stoichiometry. While in all cases the $NO_x$ emissions are clearly influenced by this parameter, the absolute $NO_x$ emission levels, particularly the minimums, are significantly different. It should thus be apparent that the performance in terms of $NO_x$ emissions reduction attained with the integrated low $NO_x$ tangential firing system 12 constructed in accordance with the present invention results from the optimized integration of the entire firing system, and not simply from the employment therein of bulk furnace staging at low stoichiometric levels.

Figure 12A:
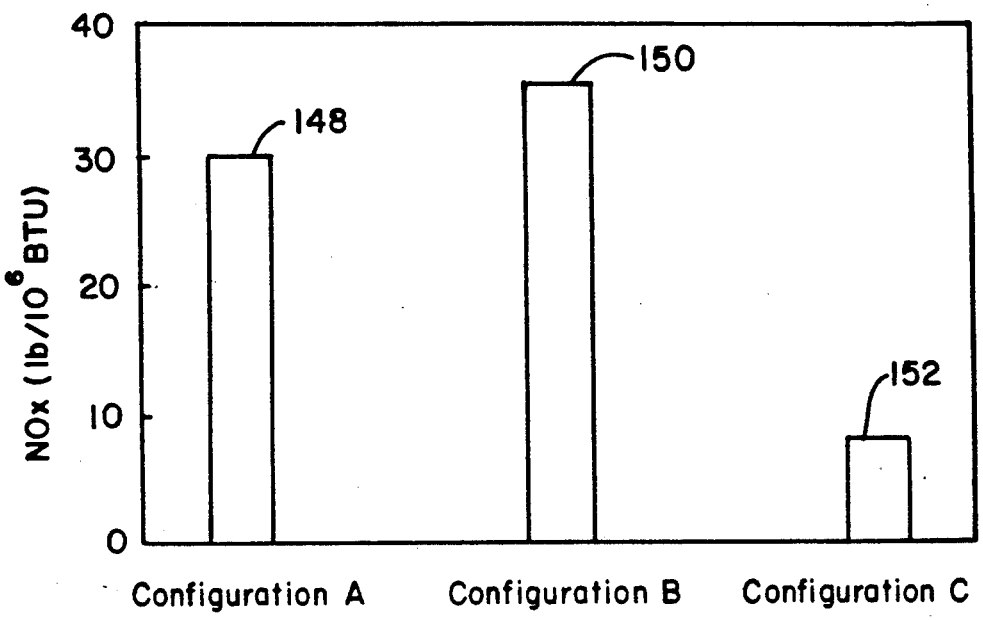
FIG. 12*a* is a graphical depiction of the effect that pulverized solid fuel fineness has on the amount of carbon-in-flyash when three differently configured forms of low $NO_x$ firing systems, each suitable for embodiment in a pulverized solid fuel-fired furnace, are employed.
Figure 12B:
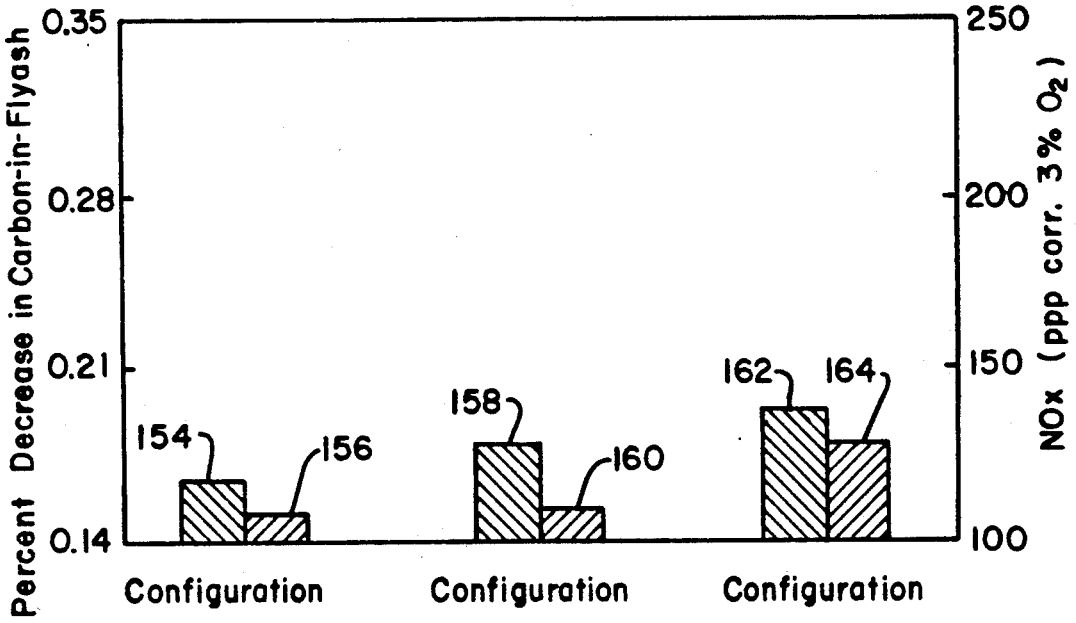
FIG. 12*b* is a graphical depiction of the effect that pulverized solid fuel fineness has on $NO_x$ emission levels when three differently configured forms of low $NO_x$ firing systems, each suitable for embodiment in a pulverized solid fuel-fired furnace, are employed.

FIG. 12*a* depicts the effect that pulverized solid fuel fineness has on the amount of carbon-in-flyash produced when firing Eastern United States pulverized solid fuel A with three differently configured forms of low $NO_x$ firing systems, denoted as configuration A which is identified therein by reference numeral 148, denoted as configuration B which is identified therein by reference numeral 150 and denoted as configuration C which is identified therein by reference numeral 152, respectively. On the other hand, FIG. 12*b* depicts the effect that pulverized solid fuel fineness has on $NO_x$ emission when firing Eastern United States pulverized solid fuel A with low $NO_x$ firing system configuration A, low $NO_x$ firing system configuration B and low $NO_x$ firing system configuration C, respectively. To this end, the results that are depicted in FIG. 12*b* were obtained with low $NO_x$ firing system configuration A when firing Eastern United States pulverized solid fuel A having a standard fineness, depicted at 154 in FIG. 12*b*, and when firing Eastern United States pulverized solid fuel A having a minimum fineness of 0% through a 50-mesh sieve, 1.5% through a 100-mesh sieve and more than 85% through a 200-mesh sieve, depicted at 156 in FIG. 12*b*; with low $NO_x$ firing system configuration B when firing Eastern United States pulverized solid fuel A having a standard fineness, depicted at 158 in FIG. 12*b* and when firing Eastern United States pulverized solid fuel A having a minimum fineness of 0% through a 50-mesh sieve, 1.5% through a 100-mesh sieve and more than 85% through a 200-mesh sieve, depicted at 160 in FIG. 12*b*; and with low $NO_x$ firing system configuration C when firing Eastern United States pulverized solid fuel A having a standard fineness, depicted at 162 in FIG. 12*b* and when firing Eastern United States pulverized solid fuel A having a minimum fineness of 0% through a 50-mesh sieve, 1.5% through a 100-mesh sieve and more than 85% through a 200-mesh sieve, depicted at 164 in FIG. 12*b*. The effect on unburned carbon depicted in FIG. 12*a* is expected, but the reduction in $NO_x$ emissions depicted in FIG. 12*b* is not well-publicized. Note is made here of the fact that neither low $NO_x$ firing system configuration A, nor low $NO_x$ firing system configuration B nor low $NO_x$ firing system configuration C embodies the configuration of the integrated low $NO_x$ tangential firing system 12 constructed in accordance with the present invention.

Figure 13A:
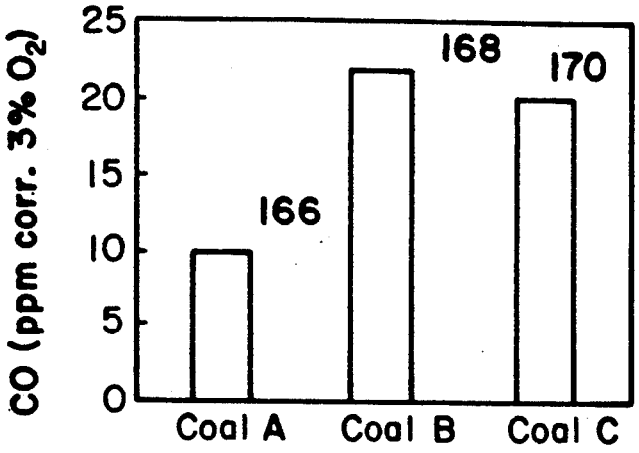
FIG. 13*a* is a graphical depiction of the amount of CO obtained from the test firing, with an integrated low $NO_x$ tangential firing system constructed in accordance with the present invention, of three different types of pulverized solid fuels.

In FIG. 13*a* there is shown the amount of CO obtained from the test firing in lab facilities with the integrated low $NO_x$ tangential firing system 12 constructed in accordance with the present invention of Eastern United States pulverized solid fuel A, depicted at 166 in FIG. 13*a;* of Eastern United States pulverized solid fuel B, depicted at 168 in FIG. 13*a;* and of Eastern United States pulverized solid fuel C, depicted at 170 in FIG. 13*a*, respectively.

Figure 13B:
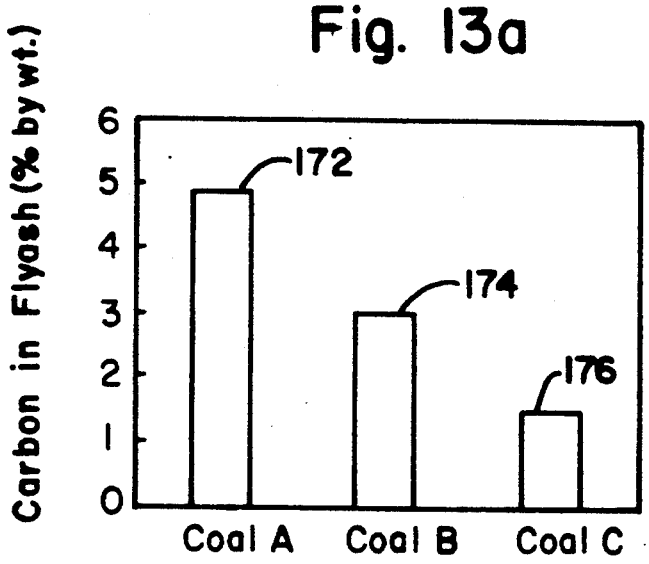
FIG. 13*b* is a graphical depiction of the amount of carbon-in-flyash obtained from the test firing, with an integrated low $NO_x$ tangential firing system constructed in accordance with the present invention, of three different types of pulverized solid fuels.

In FIG. 13*b* there is shown the amount of carbon-in-flyash obtained from the test firing in lab facilities with the integrated low $NO_x$ tangential firing system 12 constructed in accordance with the present invention of Eastern United States pulverized solid fuel A, depicted at 172 in FIG. 13*b;* of Eastern United States pulverized solid fuel B, depicted at 174 in FIG. 13*b;* and of Eastern United States pulverized solid fuel C, depicted at 176 in FIG. 13*b*.

Figure 13C:
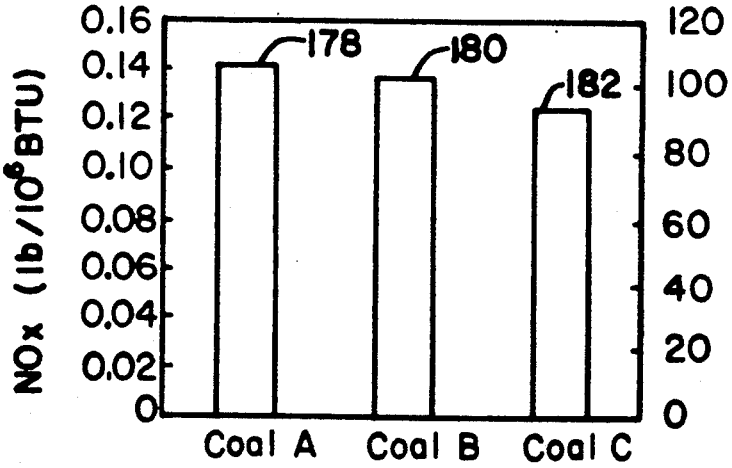
FIG. 13*c* is a graphical depiction of the $NO_x$ emission levels obtained from the test firing, with an integrated low $NO_x$ tangential firing system constructed in accordance with the present invention, of three different types of pulverized solid fuels.

In FIG. 13*c* there is shown the amount of $NO_x$ emissions obtained from the test firing in lab facilities with the integrated low $NO_x$ tangential firing system 12 constructed in accordance with the present invention of Eastern United States pulverized solid fuel A, depicted at 178 in FIG. 13*c*; of Eastern United States pulverized solid fuel B, depicted at 180 in FIG. 13*c*; and of Eastern United States pulverized solid fuel C, depicted at 182 in FIG. 13*c*.

Figure 15:
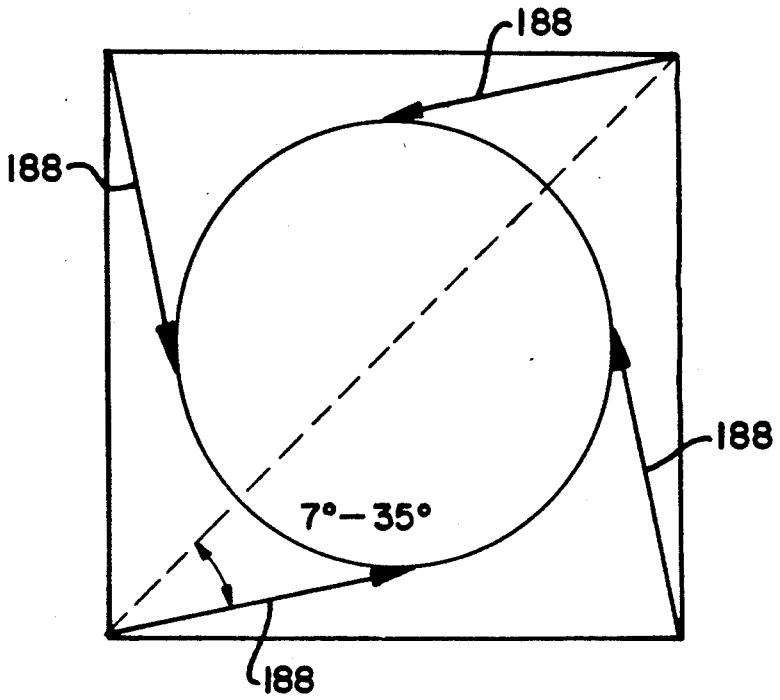
FIG. 15 is a diagrammatic representation in the nature of a plan view of a pulverized solid fuel-fired furnace embodying an integrated low $NO_x$ tangential firing system constructed in accordance with the present invention, illustrating the angles at which the pulverized solid fuel and air are injected into the pulverized solid fuel-fired furnace through the main windbox thereof in order to produce a swirl number of greater than 0.6.
Figure 14:
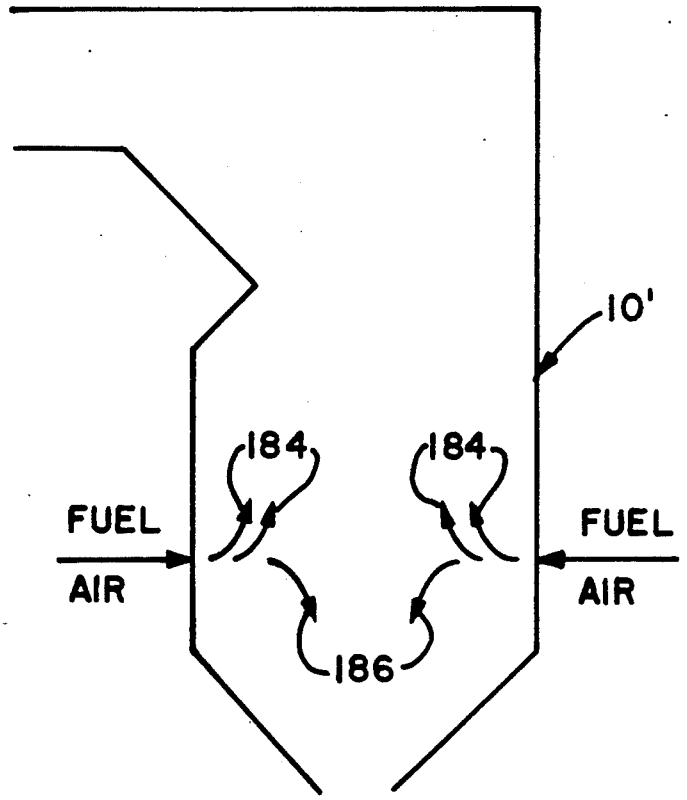
FIG. 14 is a diagrammatic representation in the nature of a vertical sectional view of a pulverized solid fuel-fired furnace embodying an integrated low $NO_x$ tangential firing system constructed in accordance with the present invention illustrating the direction of flow of the pulverized solid fuel and air injected into the pulverized solid fuel-fired furnace through the main windbox thereof, when a swirl number of greater than 0.6 is employed.

Considering next FIGS. 14 and 15 of the drawing, FIG. 14 comprises a diagrammatic representation in the nature of a vertical sectional view of a pulverized solid fuel-fired furnace, denoted generally therein by the reference numeral 10', embodying an integrated low $NO_x$ tangential firing system constructed in accordance with the present invention illustrating the direction of flow, denoted in FIG. 14 by the arrows 184 and 186 of the pulverized solid fuel and air injected into the pulverized solid fuel-fired furnace 10' through the main windbox thereof when a swirl number of greater than 0.6 is employed.

FIG. 15 comprises a diagrammatic representation in the nature of a plan view of the pulverized solid fuel-fired furnace 10' of FIG. 14 embodying an integrated low $NO_x$ tangential firing system constructed in accordance with the present invention illustrating the angles, denoted in FIG. 15 by the arrows 188, at which the pulverized solid fuel and air are injected into the pulverized solid fuel-fired furnace through the main windbox thereof in order to produce a swirl number of greater than 0.6.

With further reference to FIGS. 14 and 15 of the drawing, it has been determined that modification of the lower furnace aerodynamics of a pulverized solid fuel-fired furnace, such as the pulverized solid fuel-fired furnace 10 illustrated in FIG. 1 of the drawing, can reduce $NO_x$/carbon-in-flyash emissions. Conventional practice is to operate the lower furnace of a pulverized solid fuel-fired furnace with a "swirling, tangential" fireball. This fireball is generated from the introduction of pulverized solid fuel and combustion supporting air through nozzles provided for this purpose that are located in each of the four corners of the pulverized solid fuel-fired furnace. The pulverized solid fuel and combustion supporting air nozzles are aligned in such way that they impart a rotating, i.e., swirling, motion around an imaginary firing circle in the center of the pulverized solid fuel-fired furnace to the gases generated from the combustion of the injected pulverized solid fuel and combustion supporting air.

In accord with the proposed modification, the approach, as described hereinbefore, employed for purposes of generating the swirling function is modified. As a prelude to describing the nature of this modification, it is deemed desirable to first make mention of the terminology known as "swirl number". To this end, swirl number is a dimensionless numeral term which describes swirling aerodynamic flow fields. More specifically, swirl number is defined as the ratio of axial flux of angular momentum divided by the axial flux of linear momentum with a swirl radius term. By definition, an increase in flow field angular momentum increases swirl number, i.e., creates a more strongly swirled flow field. In accordance with conventional practice, pulverized solid fuel-fired furnaces are generally designed so as to have swirl numbers on the order of 0.4 to 0.6. This is achieved by injecting the pulverized solid fuel and combustion supporting air into the pulverized solid fuel-fired furnace at a 6° angle to the diagonal passing horizontally through the center of the pulverized solid fuel-fired furnace. Swirl numbers on the order of 0.4 to 0.6 produce what is commonly termed to be a "weak swirl" flow field, with low rates of turbulent mixing between the pulverized solid fuel and combustion supporting air, and the bulk lower furnace aerodynamics favoring moving combustion gases through the pulverized solid fuel-fired furnace in a largely positive, upward fashion.

By arranging the injection of the pulverized solid fuel and combustion supporting air at angles greater than 6° to the diagonal passing horizontally through the center of the pulverized solid fuel-fired furnace, it is possible to operate the lower furnace at swirl numbers greater than 0.6. For example, by utilizing in this regard an angle of 15°, i.e., an angle within the range depicted by the arrows 188 in FIG. 15, it is possible to produce a swirl number calculated to be 3.77. To this end, as best understood with reference to FIG. 14 of the drawing, when a swirl number is increased to this level, and more generally when the swirl number is increased beyond 0.6, a negative pressure gradient is established at the center of the swirling fireball, i.e., vortex, which as schematically depicted by the arrows 186 in FIG. 14 causes a reverse, i.e., downward, flow at the vortex core. The result of downward flow at the center of the created "fireball" is that pulverized solid fuel residence time in the lower furnace of the pulverized solid fuel-fired furnace is dramatically increased. This increased fuel residence time, combined with an optimum oxygen availability defined as the fuel stoichiometric environment, and temperatures within an optimum range creates an optimum environment to minimize $NO_x$ emissions, while the increased fuel residence time also minimizes any increase in the carbon-in-flyash emissions, which improves furnace efficiency.

Figure 16:
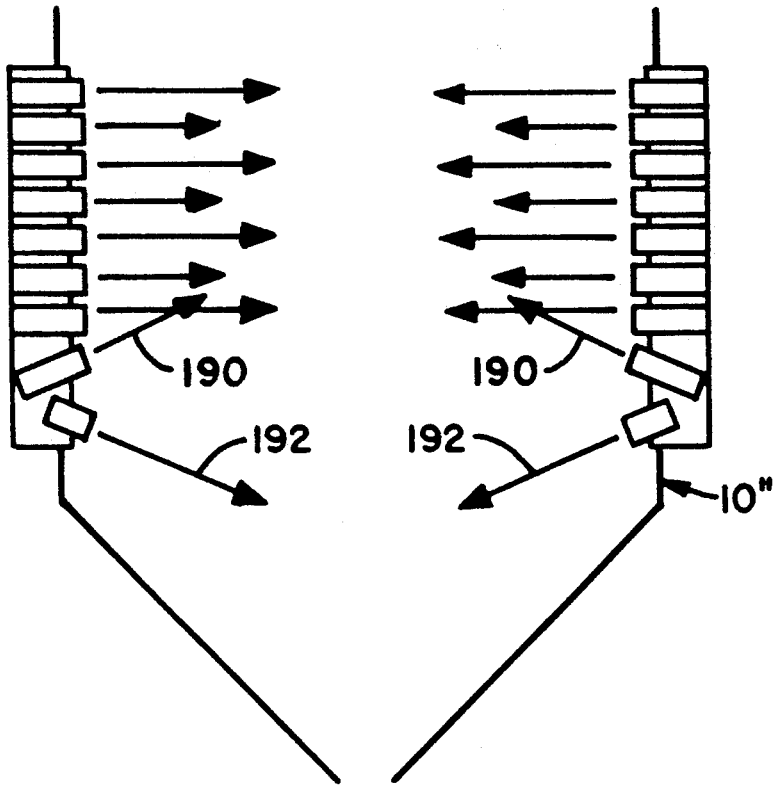
FIG. 16 is a diagrammatic representation in the nature of a vertical sectional view of a portion of a pulverized solid fuel-fired furnace embodying an integrated low $NO_x$ tangential firing system constructed in accordance with the present invention, illustrating the tilting of the lower pulverized solid fuel nozzle and the tilting of the lower air nozzle in order to achieve reduced hopper ash and increased carbon conversion.

FIG. 16 comprises a diagrammatic representation in the nature of a vertical sectional view of a pulverized solid fuel-fired furnace, denoted therein by the reference numeral 10'', embodying an integrated low $NO_x$ tangential firing system constructed in accordance with the present invention illustrating the tilting of the lower pulverized solid fuel nozzle, depicted by the arrow denoted therein by the reference numeral 190, and the tilting of the lower air nozzle, depicted by the arrow denoted therein by the reference numeral 192, in order to achieve reduced hopper ash and increased carbon conversion. A known characteristic of low $NO_x$ firing system designs is the sub-stoichiometric operation of the burner region of the pulverized solid fuel-fired furnace. This low stoichiometry is obtained by reducing the quantity of combustion supporting air that is injected into the burner region of the pulverized solid fuel-fired furnace. The resulting reduction in the local axial flow velocity contributes to the fallout of pulverized solid fuel into the hopper cooperatively associated with the pulverized solid fuel-fired furnace. However, by an up tilting of only the lower pulverized solid fuel nozzle as shown at 190 in FIG. 16 and a down tilting of the lower air nozzle as shown at 192 in FIG. 16 while all other pulverized solid fuel nozzles and combustion supporting air nozzles remain unchanged, the effect thereof is to reduce the amount of pulverized solid fuel entering the hopper as a consequence of the pulverized solid fuel being redirected instead into a zone of higher axial velocity while at the same time increasing the amount of oxygen in the hopper to ensure combustion of the pulverized solid fuel particles which might fall into the hopper.

Thus, in accordance with the present invention there has been provided a new and improved tangential firing system that is particularly suited for use with pulverized solid fuel-fired furnaces. Besides, there has been provided in accord with the present invention such a new and improved tangential firing system for pulverized solid fuel-fired furnaces which is characterized in that through the use thereof $NO_x$ emissions from pulverized solid fuel-fired furnaces can be controlled at levels, which are consistent with alternate pulverized solid fuel-based power generation technologies, such as circulating fluidized bed (CFB) and integrated gasification combined cycle (IGCC), without utilizing either selective catalytic reduction (SCR) or selective non-catalytic reduction (SNCR). As well, in accordance with the present invention there has been provided such a new and improved tangential firing system for pulverized solid fuel-fired furnaces which is characterized in that through the use thereof $NO_x$ emissions from pulverized solid fuel-fired furnaces can be limited to less than 0.15 lb./$10^6$ BTU while yet at the same time limiting carbon-in-flyash to less than 5% and CO emissions to less than 50 ppm. Moreover, there has been provided in accord with the present invention such a new and improved tangential firing system for pulverized solid fuel-fired furnaces which is characterized in that through the use thereof $NO_x$ emissions from pulverized solid fuel-fired furnaces can be limited to less than 0.15 lb./$10^6$ BTU while a wide range of solid fuels, from medium-volatile bituminous coal through lignite, are being fired in the pulverized solid fuel-fired furnace. Also, in accordance with the present invention there has been provided such a new and improved tangential firing system for pulverized solid fuel-fired furnaces which is characterized in that included therewithin as an element thereof is solid fuel pulverization and classification. Further, there has been provided in accord with the present invention such a new and improved tangential firing system for pulverized solid fuel-fired furnaces which is characterized in that included therewithin as an element thereof is pulverized solid fuel admission and combustion near the pulverized solid fuel nozzle tip. In addition, in accordance with the present invention there has been provided such a new and improved tangential firing system for pulverized solid fuel-fired furnaces which is characterized in that included therewithin as an element thereof is lower furnace combustion. Furthermore, there has been provided in accord with the present invention such a new and improved tangential firing system for pulverized solid fuel-fired furnaces which is characterized in that included therewithin as an element thereof is upper furnace combustion. Additionally, in accordance with the present invention there has been provided such a new and improved tangential firing system for pulverized solid fuel-fired furnaces which is characterized in that finer solid fuel pulverization is combined therewithin with advanced pulverized solid fuel admission assemblies and in-furnace air staging utilizing multiple air injection levels such that the new and improved tangential firing system thereby constitutes a new and improved integrated tangential firing system for pulverized solid fuel-fired furnaces. Penultimately, there has been provided in accord with the present invention such a new and improved integrated tangential firing system for pulverized solid fuel-fired furnaces which is characterized in that it is equally well suited for use in either new applications or in retrofit applications. Finally, in accordance with the present invention there has been provided such a new and improved integrated tangential firing system for pulverized solid fuel-fired furnaces which is characterized in that it is relatively easy to install, relatively simple to operate, yet is relatively inexpensive to provide.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. An integrated low $NO_x$ tangential firing system for a pulverized solid fuel-fired furnace having a plurality of walls embodying therewithin a burner region containing a multiplicity of combustion zones of differing stoichiometries comprising:

a. a pulverized solid fuel supply means for supplying pulverized solid fuel of a predetermined fineness;

b. a windbox mounted within the burner region of the pulverized solid fuel-fired furnace;

c. a plurality of pulverized solid fuel compartments mounted within said windbox;

d. a flame attachment pulverized solid fuel nozzle tip supported in mounted relation within each of said plurality of pulverized solid fuel compartments, each of said plurality of flame attachment pulverized solid fuel nozzle tips, being connected to said pulverized solid fuel supply means for receiving therefrom pulverized solid fuel of a predetermined fineness, said flame attachment pulverized solid fuel nozzle tips being operative to effect the injection therethrough into the burner region of the pulverized solid fuel-fired furnace of the pulverized solid fuel of a predetermined fineness received thereby from said pulverized solid fuel supply means in such a manner that the ignition point of the injected pulverized solid fuel of a predetermined fineness is located less than two feet from said flame attachment pulverized solid fuel nozzle tips;

e. a plurality of combustion supporting air compartments mounted within said windbox, said plurality of combustion supporting air compartments being operative to inject therethrough into the burner region of the pulverized solid fuel-fired furnace a sufficient quantity of combustion supporting air such that the stoichiometry is between 0.4 and 0.75 in a first combustion zone of the burner region of the pulverized solid fuel-fired furnace;

f. at least one close coupled overfire air compartment mounted in said windbox, said at least one close coupled overfire air compartment being operative to inject therethrough into the burner region of the pulverized solid fuel-fired furnace a sufficient quantity of close coupled overfire air such that the stoichiometry is between 0.7 and 0.9 in a second combustion zone of the burner region of the pulverized solid fuel-fired furnace;

g. a low level of separated overfire air located in spaced relation to said windbox within the burner region of the pulverized solid fuel-fired furnace, said low level of separated overfire air being operative to inject into the burner region of the pulverized solid fuel-fired furnace a sufficient quantity of separated overfire air such that the stoichiometry is between 0.9 and 1.02 in a third combustion zone of the burner region of the pulverized solid fuel-fired furnace; and h. a high level of separated overfire air located in spaced relation to both said low level of separated overfire air and said windbox such that the time that it takes for the gases generated from the combustion of the injected pulverized solid fuel to travel from the top of said windbox to the top of said high level of separated overfire air exceeds 0.3 seconds, said high level of separated overfire air being operative to inject into the burner region of the pulverized solid fuel-fired furnace a sufficient quantity of separated overfire air such that the stoichiometry exceeds 1.07 in a fourth combustion zone of the burner region of the pulverized solid fuel-fired furnace.

2. The integrated low $NO_x$ tangential firing system as set forth in claim 1 wherein said pulverized solid fuel supply means includes a pulverizer operative for pulverizing solid fuel to said predetermined fineness, and a plurality of pulverized solid fuel ducts each having one end thereof connected to said pulverizer and the other end thereof connected to one of said plurality of pulverized solid fuel compartments for transporting pulverized solid fuel of said predetermined fineness from said pulverizer to said one of said plurality of pulverized solid fuel compartments.

3. The integrated low $NO_x$ tangential firing system as set forth in claim 2 wherein said predetermined fineness comprises minimum fineness levels of approximately 0% on a 50-mesh sieve, 1.5% on a 100-mesh sieve and more than 85% passing through a 200-mesh sieve.

4. The integrated low $NO_x$ tangential firing system as set forth in claim 1 wherein each of said flame attachment pulverized solid fuel nozzle tips comprises a rectangular shaped box having open ends located at opposite ends thereof, a passageway located in surrounding relation to said rectangular shaped box in slightly spaced relation thereto, a multiplicity of bar-like members supported in mounted relation within said rectangular shaped box such that said multiplicity of bar-like members are located symmetrically about the axes and center of the exit plane of said flame attachment pulverized solid fuel nozzle tip, a plurality of shear bars supported in mounted relation within said rectangular shaped box so as to be located at the top and at the bottom of the exit plane of said flame attachment pulverized solid fuel nozzle tip, and a plurality of interconnection members interconnecting said multiplicity of bar-like members with said plurality of shear bars.

5. The integrated low $NO_x$ tangential firing system as set forth in claim 1 wherein said plurality of combustion supporting air compartments includes a pair of end air compartments located in spaced relation one to another and at opposite ends of said windbox.

6. The integrated low $NO_x$ tangential firing system as set forth in claim 5 wherein said first combustion zone comprises that portion of the burner region lying between said pair of end air compartments.

7. The integrated low $NO_x$ tangential firing system as set forth in claim 5 wherein said plurality of combustion supporting air compartments includes a plurality of straight air compartments located in spaced relation one to another and intermediate said pair of end air compartments.

8. The integrated low $NO_x$ tangential firing system as set forth in claim 7 wherein said plurality of combustion supporting air compartments includes a plurality of offset air compartments located in spaced relation one to another and intermediate said pair of end air compartments, said plurality of offset air compartments being operable to horizontally offset the combustion supporting air injected therethrough in order that less combustion supporting air is available to the injected pulverized solid fuel during the early stages of combustion thereof.

9. The integrated low $NO_x$ tangential firing system as set forth in claim 5 wherein a pair of close coupled overfire air compartments are located in juxtaposed relation to one of said pair of end air compartments.

10. The integrated low $NO_x$ tangential firing system as set forth in claim 9 wherein said low level of separated overfire air comprises three separated overfire air compartments located one above the other.

11. The integrated low $NO_x$ tangential firing system as set forth in claim 9 wherein said second combustion zone comprises that portion of the burner region lying between the uppermost one of said pair of close coupled overfire air compartments and said three separated overfire air compartments of said low level of separated overfire air.

12. The integrated low $NO_x$ tangential firing system as set forth in claim 10 wherein said high level of separated overfire air comprises three separated overfire air compartments located one above the other.

13. The integrated low $NO_x$ tangential firing system as set forth in claim 10 wherein said third combustion zone comprises that portion of the burner region lying between the uppermost one of said three separated overfire air compartments of said low level of separated overfire air and said three separated overfire air compartments of said high level of separated overfire air.

14. The integrated low $NO_x$ tangential firing system as set forth in claim 13 wherein said fourth combustion zone comprises that portion of the burner region lying above the uppermost one of said three separated overfire air compartments of said high level of separated overfire air.

15. The integrated low $NO_x$ tangential firing system as set forth in claim 1 wherein the pulverized solid fuel injected into the burner region of the pulverized solid fuel-fired furnace through said flame attachment pulverized solid fuel nozzle tips and the combustion supporting air injected into the burner region of the pulverized solid fuel-fired furnace through said plurality of combustion supporting air compartments are each injected at an angle to the diagonal passing through the center of the pulverized solid fuel-fired furnace so as to thereby produce a swirl number greater than 0.6 within the pulverized solid fuel-fired furnace.

16. A method of operating a pulverized solid fuel-fired furnace having a plurality of walls embodying therewithin a burner region containing a multiplicity of combustion zones of differing stoichiometries comprising the steps of:

a. providing a supply of pulverized solid fuel of a predetermined fineness;

b. injecting the pulverized solid fuel of a predetermined fineness into the burner region of the pulverized solid fuel-fired furnace through flame attachment nozzle tips to that the ignition point of the injected pulverized solid fuel is located less than two feet from the flame attachment pulverized solid fuel nozzle tips;

c. injecting a sufficient quantity of combustion supporting air into the burner region of the pulverized solid fuel-fired furnace such that the stoichiometry is between 0.5 and 0.7 in a first combustion zone of the burner region of the pulverized solid fuel-fired furnace;

d. injecting a sufficient quantity of close coupled overfire air into the burner region of the pulverized solid fuel-fired furnace such that the stoichiometry is between 0.7 and 0.9 in a second combustion zone of the burner region of the pulverized solid fuel-fired furnace;

e. injecting a sufficient quantity of low level separated overfire air into the burner region of the pulverized solid fuel-fired furnace such that the stoichiometry is between 0.9 and 1.02 in a third combustion zone of the burner region of the pulverized solid fuel-fired furnace; and f. injecting a sufficient quantity of high level separated overfire air into the burner region of the pulverized solid fuel-fired furnace such that the stoichiometry exceeds 1.07 in a fourth combustion zone of the burner region of the pulverized solid fuel-fired furnace.

17. The method as set forth in claim 16 wherein the point of injection of the high level separated overfire air into the burner region of the pulverized solid fuel-fired furnace is sufficiently spaced from the point of injection of the close coupled overfire air into the burner region of the pulverized solid fuel-fired furnace that the time that it takes for the gases generated from the combustion of the injected pulverized solid fuel to travel therebetween exceeds 0.3 seconds.

18. The method as set forth in claim 16 wherein the pulverized solid fuel injected into the burner region of the pulverized solid fuel-fired furnace has a minimum fineness of approximately 0% on a 50-mesh sieve, 1.5% on a 100-mesh sieve and more than 85% passing through a 200-mesh sieve.

19. The method as set forth in claim 16 wherein a portion of the combustion supporting air injected into the burner region of the pulverized solid fuel-fired furnace is injected as end air.

20. The method as set forth in claim 19 wherein a portion of the combustion supporting air injected into the burner region of the pulverized solid fuel-fired furnace is injected as straight air.

21. The method as set forth in claim 20 wherein a portion of the combustion supporting air is injected into the burner region of the pulverized solid fuel-fired furnace is injected as horizontally offset air so that less combustion supporting air is available to the injected pulverized solid fuel during the early stages of the combustion thereof.

22. The method as set forth in claim 16 wherein the pulverized solid fuel injected into the burner region of the pulverized solid fuel-fired furnace and the combustion supporting air injected into the burner region of the pulverized solid fuel-fired furnace are each injected at an angle to the diagonal passing through the center of the pulverized solid fuel-fired furnace so as to thereby produce a swirl number greater than 0.6 within the pulverized solid fuel-fired furnace.

23. The method as set forth in claim 16 wherein at least a portion of the pulverized solid fuel injected into the burner region of the pulverized solid fuel-fired furnace is injected thereinto in an upwardly direction.

24. The method as set forth in claim 16 wherein at least a portion of the combustion supporting air injected into the burner region of the pulverized solid fuel-fired furnace is injected thereinto in a downwardly direction.

25. A flame attachment pulverized solid fuel nozzle tip for a low $NO_x$ firing system of a pulverized solid fuel-fired furnace comprising:

a. a rectangular shaped box having open ends located at opposite end thereof;

b. a multiplicity of bar-like members supported in mounted relation within said rectangular shaped box such that said multiplicity of bar-like members are located symmetrically about the axes and center of the exit plane of the flame attachment pulverized solid fuel nozzle tip;

c. a plurality of shear bars supported in mounted relation within said rectangular shaped box so as to be located at the top and at the bottom of the exit plane of the flame attachment pulverized solid fuel nozzle tip; and d. a plurality of interconnection members interconnecting said multiplicity of bar-like members with said plurality of shear bars.

* * * * *